United States Patent [19]

Ogawa

[11] Patent Number: 4,791,053

[45] Date of Patent: Dec. 13, 1988

[54] SILVER HALIDE PHOTOGRAPHIC MATERIAL

[75] Inventor: Tadashi Ogawa, Kanagawa, Japan

[73] Assignee: Fuji Photo Film Co., Ltd., Kanagawa, Japan

[21] Appl. No.: 937,293

[22] Filed: Dec. 3, 1986

[30] Foreign Application Priority Data

Dec. 3, 1985 [JP] Japan ..... 60-271885
May 26, 1986 [JP] Japan ..... 61-120598
Jun. 5, 1986 [JP] Japan ..... 61-130737

[51] Int. Cl.[4] ..... G03C 1/12; G03C 1/02

[52] U.S. Cl. ..... 430/581; 430/583; 430/584; 430/585; 430/588; 430/567; 430/569; 430/599

[58] Field of Search ..... 430/569, 570, 567, 603, 430/604, 605, 599, 583, 584, 585, 588, 581

[56] References Cited

U.S. PATENT DOCUMENTS 4,183,756 1/1980 Locker ..... 430/569
4,225,666 9/1980 Locker et al. ..... 430/569
4,286,055 8/1981 Forster et al. ..... 430/567
4,683,193 7/1987 Ihama et al. ..... 430/569

*Primary Examiner*—Won H. Louie
*Attorney, Agent, or Firm*—Sughrue, Mion, Zinn, Macpeak, and Seas

[57] ABSTRACT

A silver halide photographic material comprising a support having thereon at least one emulsion layer which contains a silver chlorobromide or silver chloride each having an iodide content of 3 mol % or less. The monodispersed emulsion is prepared in a process comprising the steps of, in sequence, forming silver halide grains which have a grain size distribution represented by a variation coefficient of 0.2 or less, causing halogen replacement in silver halide grains by addition of a water-soluble bromide in a proportion of from 0.6 to 20 mol % with respect to the total silver halide in the presence of at least one sensitizing dye selected from among simple cyanine dyes, carbocyanine dyes, and dicarbocyanine dyes at individual surfaces of the silver halide grains, and then subjecting the resulting silver halide grains to chemical sensitization, thereby achieving enhanced sensitivity and improved pressure characteristics.

9 Claims, No Drawings

SILVER HALIDE PHOTOGRAPHIC MATERIAL

FIELD OF THE INVENTION

The present invention relates to a silver halide photographic material and, more particularly, to a silver halide photographic material which has high sensitivity and is excellent in various characteristics required thereof in the overall process extending over exposure and photographic processing.

BACKGROUND OF THE INVENTION

In recent years, the printing step and development processing step for photographic materials for print use have been conducted ever more quickly, and this trend requires of the materials for print use still more emphatically to have high sensitivity, to be stable in the course of photographic processing, and to be durable upon handling. The most basic method for enhancing the sensivity of a silver halide emulsion consists in increasing optical absorption per silver halide grain through an increase in grain size. When an emulsion is spectrally sensitized, on the other hand, the increase in optical absorption can be effected by increasing optical absorption on the part of sensitizing dyes which can transmit photoelectrons to silver halides to result in the formation of latent images. However, these methods do not necessarily always lead to satisfactory results. For instance, it happens that an increase in grain size hinders the speeding-up of development processing, while spectral sensitization causes inhibition of development or desilvering. In general, what is worse, it rarely occurs in spectrally sensitized emulsions that there is room for enhancing the sensitivity through further addition of sensitizing dyes or other means. Therefore, methods for enhancing the sensitivity of silver halide grains without increasing the grain size or the addition amount of sensitizing dyes are very desirable.

Representative of such methods are those known as so-called chemical sensitization, with specific examples including the method of using a sulfur sensitizer like sodium thiosulfate, the method of using a gold sensitizer like potassium chloroaurate, the method of using a reduction sensitizer like stannous chloride, or the method of using these sensitizers in combination. Although these chemical sensitizing methods control the attainable sensitivity through a proper choice of the kind and amount of sensitizer to be used, or a manner of adding and a way of combining sensitizers, it is impossible to decide the attainable sensitivity by these factors alone, for different results are brought about depending on properties possessed of silver halide grains themselves prior to an application of chemical sensitization. For example, the fact that effects produced on silver halide grains by sulfur sensitization differ in different crystal habits is described in *The Journal of Photographic Science,* Vol. 14, pp. 181–184 (1966). In addition, the role played by the crystal habit of grains in the latent image formation, including in the reduction sensitization step also, is described in ibid., Vol. 23, pp. 249–256 (1975). Moreover, the effects of halogen species forming grains in an emulsion and a crystal habit of the grains upon light sensitivity gained by sulfur sensitization and gold-sulfur sensitization and upon fog caused thereby are described in *Photographic Science and Engineering,* Vol. 28, pp. 146 to 149 (1984). However, those reports describe only the influences which the properties of silver halide grains exercise upon chemical sensitization and photographic speed, and they do not describe any art and methods which can respond to the foregoing demands in the market, that is, the attainment of further increases in sensitivity and handling stability.

Accordingly, it has been strongly desired to find out methods for achieving efficient enhancement of the sensitivity without increasing the size of silver halide grains. In addition, such methods are expected to be accompanied with further improvements on stability during the photographic processing and durability upon handling.

As a method for enhancing the sensitivity of silver halide, a grain-forming method is known as described in Japanese Patent Publication No. 36978/75, wherein so-called halogen replacement is utilized.

Silver halide emulsions prepared using such a method are characterized by increased sensitivity and reduced pressure marks. However, we have found that such emulsions have serious defects, notwithstanding the desirable characteristics as described above. Particularly, such emulsions show a decrease in mechanical pressure marks on the one hand, but on the other hand a marked desensitization phenomenon is observed in areas to which mechanical pressure has been applied prior to exposure. Although decreasing the number of halogen atoms to be replaced makes it possible to mitigate the desensitization phenomenon, such tends to increase generation of pressure marks, and what is worse, it results in both pressure marks and desensitization occurring in undesirable conditions in most cases. That is to say, reduction of pressure marks seems to be incompatible with mitigation of the desensitization phenomenon. Moreover, it has been found that reduction of halogen replacement rate brings about decrease in contrast of the emulsions.

Japanese Patent Publication No. 46932/74 and Japanese Patent Application (OPI) No. 9653/84 (the term "OPI" as used herein refers to a "published unexamined Japanese patent application") each discloses a silver halide photographic material containing a support having thereon at least one of a spectrally sensitized and monodispersed silver chlorobromide emulsion which is prepared by the steps of, in sequence, subjecting the silver halide emulsion to chemical sensitization (ripening) and then adding thereto a specific amount of a water-soluble bromide. However, these prior art photographic emulsions are insufficient for minimizing pressure marks.

SUMMARY OF THE INVENTION

Therefore, an object of the present invention is to solve the above-described problems and to provide a highly sensitive, stable silver halide emulsion. More specifically, the object of this invention is to provide a method for preparing a silver halide emulsion which enables efficient enhancement of the sensitivity upon chemical sensitization, and the provision of a silver halide photographic material containing said emulsion.

The above-described object is attained with a silver halide photographic material comprising a support having thereon at least one emulsion layer which contains a monodispersed silver chlorobromide or silver chloride each having an iodide content of 3 mol% or less, which is prepared in a process comprising the steps of, in sequence, forming silver halide grains which have a grain size distribution represented by a variation coefficient of 0.2 or less, causing halogen replacement in silver halide grains by the addition of a water-soluble bromide in a proportion of from 0.6 to 20 mol% with respect to the total silver halide in the presence of at least one kind of sensitizing dye selected from among simple cyanine dyes, carbocyanine dyes, and dicarbocyanine dyes at the individual surfaces of silver halide grains, and then subjecting the resulting silver halide grains to chemical sensitization.

DETAILED DESCRIPTION OF THE INVENTION

Water-soluble bromides are those liberating bromide ions in an aqueous solution, and specific examples thereof which can be used herein include alkali metal and ammonium salts, such as potassium bromide, sodium bromide, ammonium bromide, etc. Since it is essential to the present invention that halogen replacement takes place by addition of the water-soluble bromides, silver halide grains prior to reception of halogen replacement must comprise silver salts more soluble in water relative to the silver salt to be converted by the halogen replacement. More specifically, silver halide grains to be employed in the present invention are those comprising silver chloride or the like which can be converted to silver bromide through bromine ion by the difference of the solubility. A silver chloride content in the emulsion prior to reception of halogen replacement may be an arbitrary value ranging from 0 mol% to 100 mol%, but preferably is from 4 mol% to 100 mol%. A part or almost all of the readily soluble silver salt contained in the silver halide grains may be converted to silver bromide. The amount of water-soluble bromide added should not be smaller than that of the readily soluble silver salt to undergo conversion, but the amount may be larger. The amount of water-soluble bromide to be added must range from 0.6 mol% to 20 mol% based on the whole silver halides in the emulsion. More preferably, it is within the range of from 1 to 15 mol%. When the amount is less than 0.6 mol%, the addition of water-soluble bromide is hard to produce the effect of the present invention, whereas the addition beyond 20 mol% causes marked desensitization under mechanical stress and leads to an undesirable result. There is no particular limitation as to a temperature of the emulsion upon halogen replacement. However, desirable temperatures of the emulsion for effecting halogen replacement are typically 70° C. or less, preferably 60° C. or less, and more preferably 50° C. or less.

The halogen replacement in the present invention is carried out in the presence of a simple cyanine dye, a carbocyanine dye, or a dicarbocyanine dye. These cyanine dyes can be represented by formula (I) (in which the positions of the double bonds may be shifted through its resonance structures)

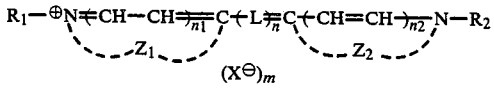

(I)

wherein L represents a methine group or a substituted methine group; $R_1$ and $R_2$ each represents an alkyl group or a substituted alkyl group; $Z_1$ and $Z_2$ each represents atoms forming a nitrogen-containing 5- or 6-membered heterocyclic nucleus; X represents an anion; n represents 1, 3 or 5; $n_1$ and $n_2$ each represents 0 or 1, provided that $n_1$ and $n_2$ are 0 when n=5, and that when n=3, either $n_1$ or $n_2$ is 0; m represents 0 or 1, provided that m is 0 when (I) forms an inner salt; or, when n represents 5, the two L groups combine together to form a substituted or unsubstituted 5- or 6-membered ring.

Cyanine dyes represented by formula (I) are described in more detail below.

Suitable examples of a substituent group of the substituted methine group represented by L can include lower alkyl groups (e.g., a methyl group, an ethyl group, etc.) and aralkyl groups (e.g., a benzyl group, a phenethyl group, etc.).

Alkyl groups represented by $R_1$ and $R_2$ may take a straight chain, branched chain or cyclic form. They have no particular limitation as to the number of carbon atoms contained therein. However, 1 to 8, and particularly 1 to 4, are preferred as the number of carbon atoms therein. As for the substitutent groups that the alkyl groups may have, a sulfo group, a carboxyl group, a hydroxyl group, an alkoxyl group, an acyloxy group, an aryl group (e.g., a phenyl group) and so on can be cited as examples. These groups may be attached to an alkyl group individually or in combinations of two or more thereof. In addition, the sulfo group and the carboxyl group may form a salt together with an alkali metal ion or a quaternary organic amine ion. The expression "in combinations of two or more thereof" used above is intended to include not only the case in which the above-described substituent groups are attached to an alkyl group independently but also the case in which two or more of the above-described substituent groups are connected together to form a group, and the resulting group is bound to an alkyl group. As examples of groups corresponding to the latter case, mention may be made of sulfoalkoxyalkyl groups, sulfoalkoxyalkoxyalkyl groups, carboxyalkoxyalkyl groups, sulfophenylalkyl groups and so on.

Specific examples of groups represented by $R_1$ and $R_2$ include a methyl group, an ethyl group, an n-propyl group, a vinylmethyl group, a 2-hydroxyethyl group, a 4-hydroxybutyl group, a 2-acetoxyethyl group, a 3-acetoxypropyl group, a 2-methoxyethyl group, a 4-methoxybutyl group, a 2-carboxyethyl group, a 3-carboxypropyl group, a 2-(2-carboxyethoxy)ethyl group, a 2-sulfoethyl group, a 3-sulfopropyl group, a 3-sulfobutyl group, a 4-sulfobutyl group, a 2-hydroxy-3-sulfopropyl group, a 2-(3-sulfopropoxy)ethyl group, a 2-acetoxy-3-sulfopropyl group, a 3-methoxy-2-(3-sulfopropoxy)propyl group, a 2-[2-(3-sulfopropoxy)ethoxy]ethyl group, a 2-hydroxy-3-(3'-sulfopropoxy)propyl group, and so on.

Specific examples of a nitrogen-containing heterocyclic nucleus completed by $Z_1$ or $Z_2$ include an oxazole nucleus, a thiazole nucleus, a selenazole nucleus, an imidazole nucleus, a pyridine nucleus, an oxazoline nucleus, a thiazoline nucleus, a selenazoline nucleus, an imidazoline nucleus, and nuclei formed by condensing one of these nuclei and a benzene, naphthalene or another saturated or unsaturated carbon ring. These nitrogen-containing hetero rings may be substituted with certain substituent groups (e.g., an alkyl group, a trifluoromethyl group, an alkoxycarbonyl group, a cyano group, a carboxyl group, a carbamoyl group, an alkoxy group, a halogen atom, an aryl group, an acyl group, a hydroxyl group, etc.).

Specific examples of an anion represented by X include $Cl^{\ominus}$, $Br^{\ominus}$, $I^{\ominus}$, $SO_4^{2\ominus}$, $NO_3^{\ominus}$, $ClO_4^{\ominus}$, and so on.

Specific examples of cyanine dyes represented by formula (I) are illustrated below, although the present invention is not to be construed as being limited thereto. In the following structural formulae, Et means an ethyl group.
D-1
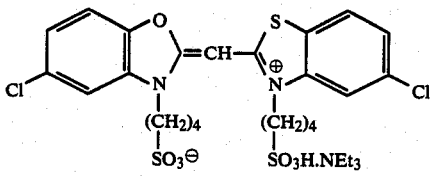
D-2
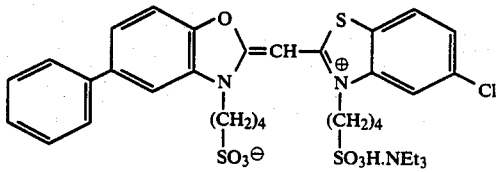
D-3
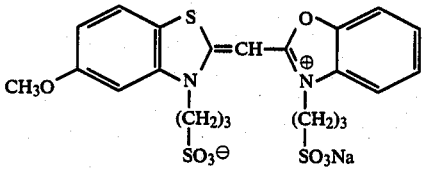
D-4
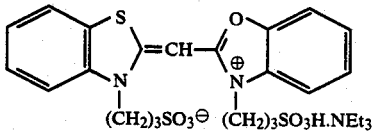
D-5
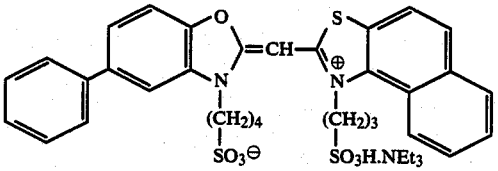
D-6
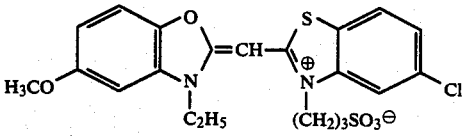
D-7
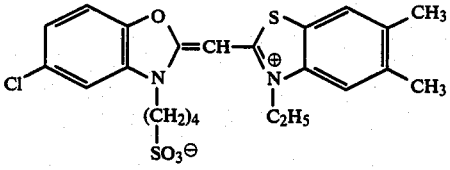
D-8
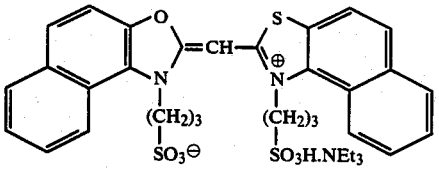
D-9
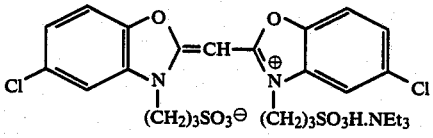
D-10
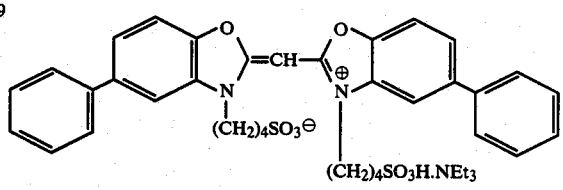
D-11
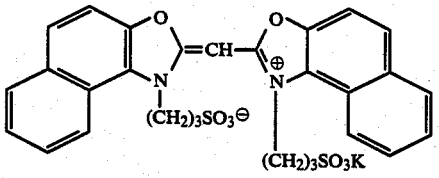
D-12
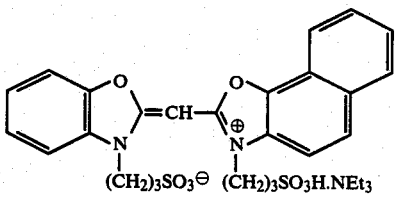
D-13
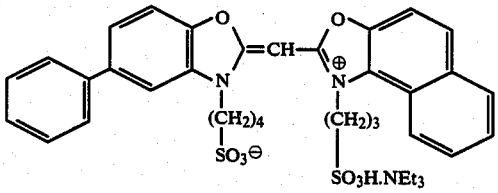
D-14
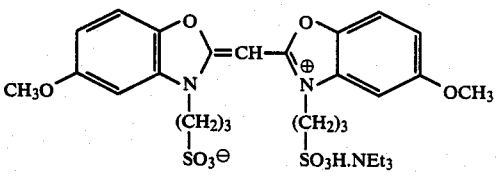
D-15
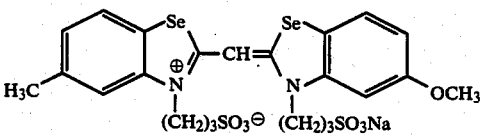
D-16
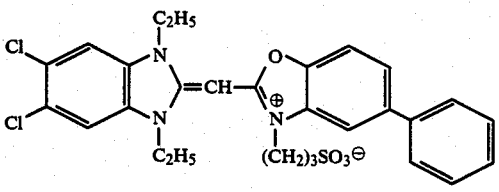

-continued
D-17
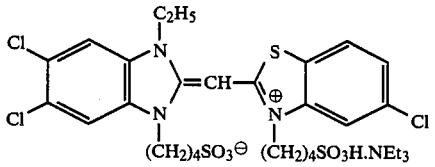
D-18
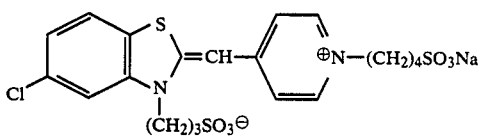
D-19
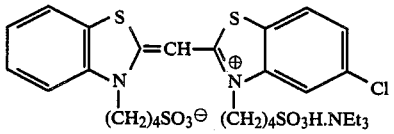
D-20
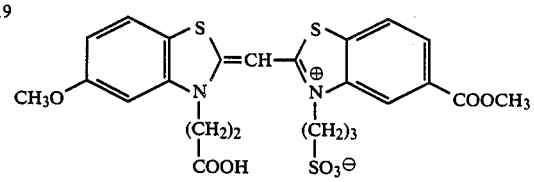
D-21
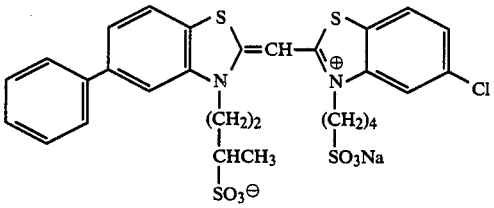
D-22
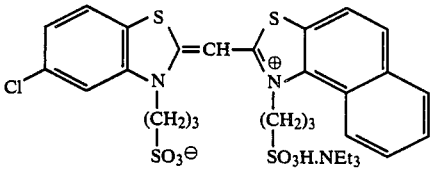
D-23
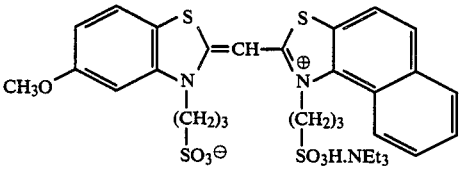
D-24
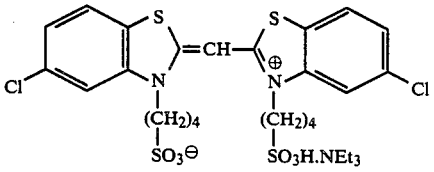
D-25
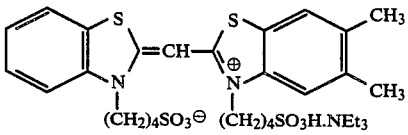
D-26
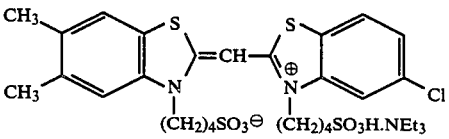
D-27
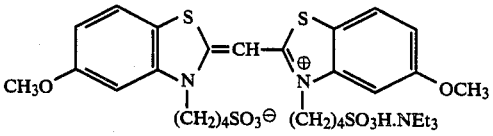
D-28
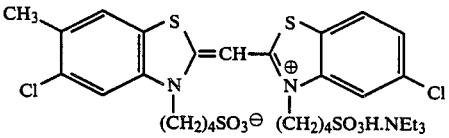
D-29
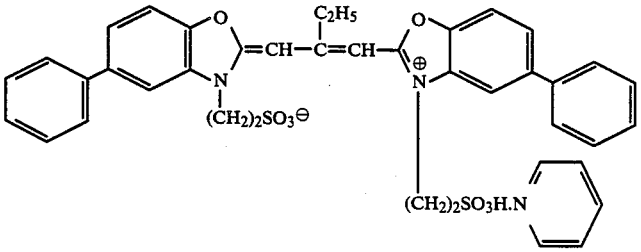
D-30
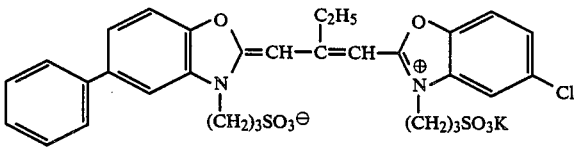
D-31
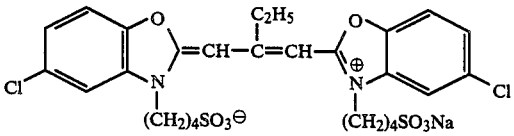

-continued
D-32
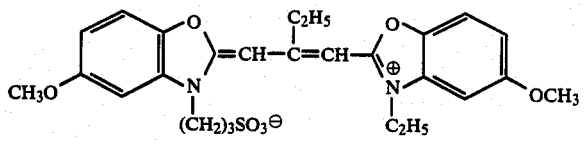
D-33
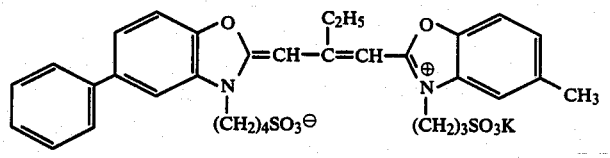
D-34
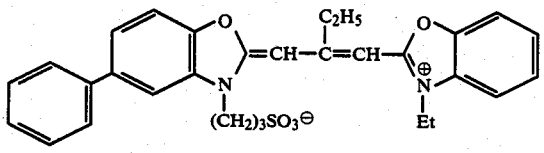
D-35
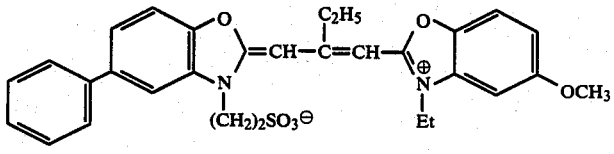
D-36
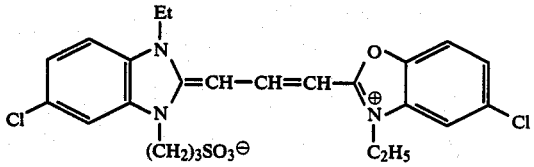
D-37
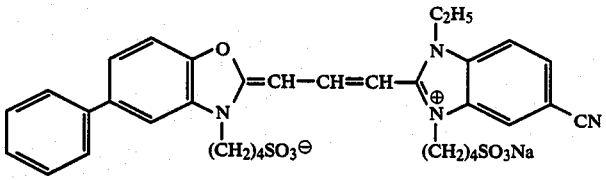
D-38
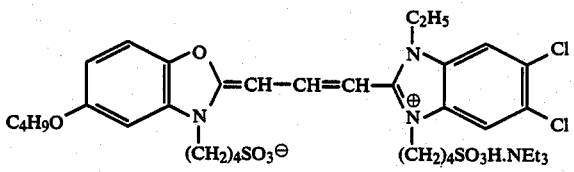
D-39
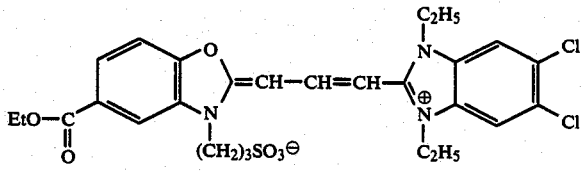
D-40
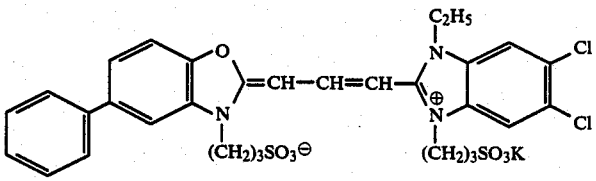

-continued
D-41
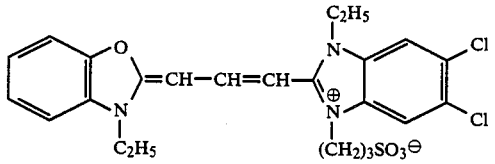
D-42
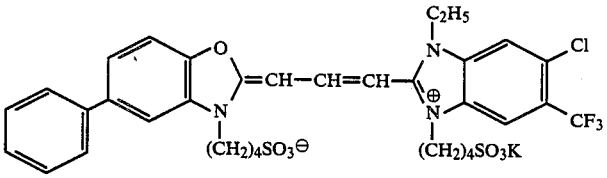
D-43
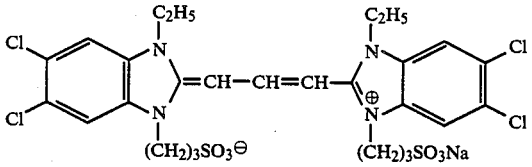
D-44
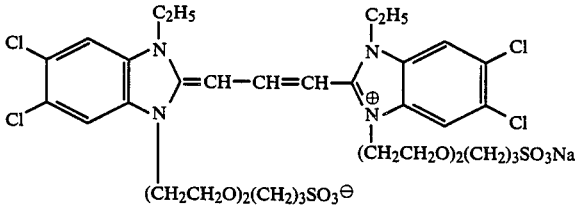
D-45
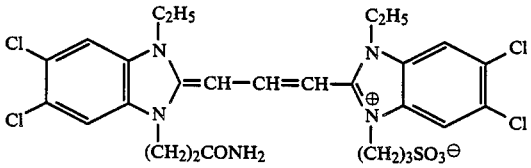
D-46
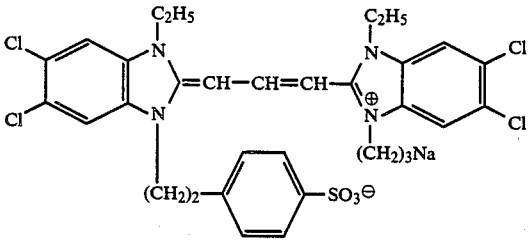
D-47
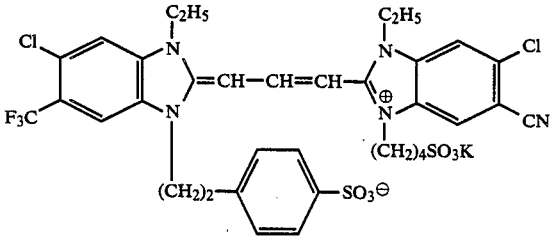
D-48
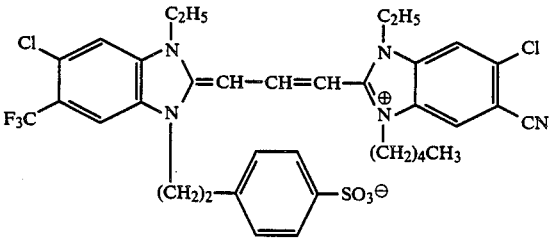

-continued
D-49
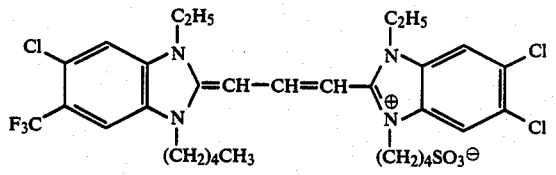
D-50
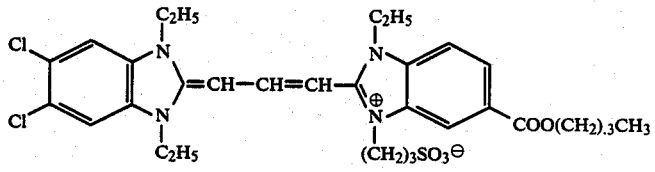
D-51
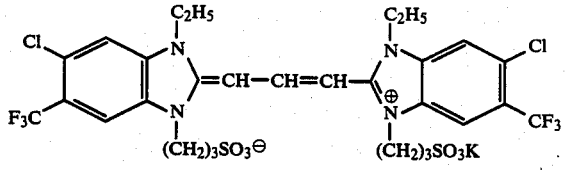
D-52
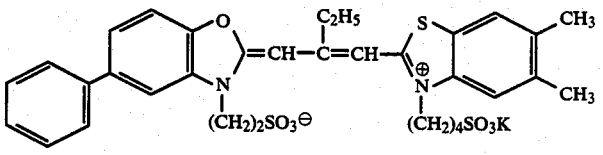
D-53
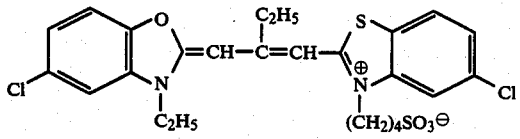
D-54
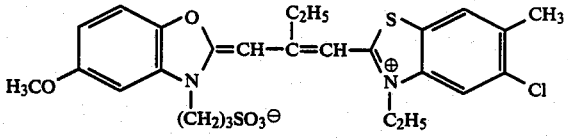
D-55
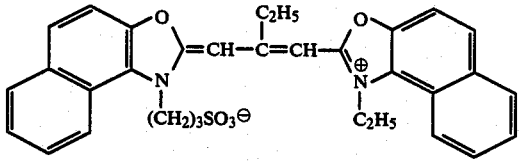
D-56
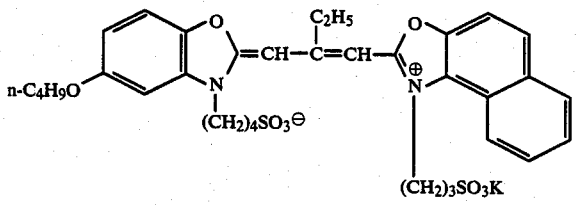
D-57
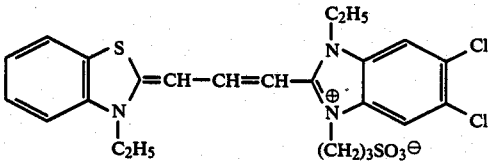

-continued
D-58
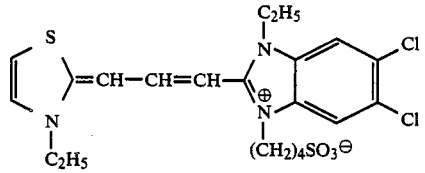
D-59
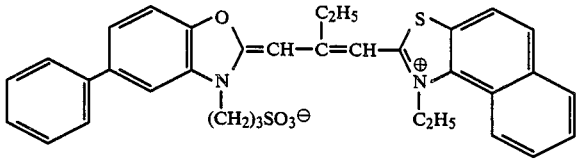
D-60
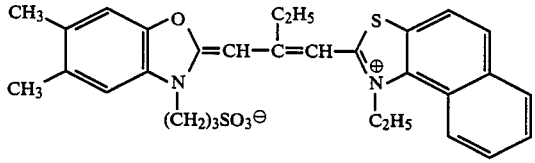
D-61
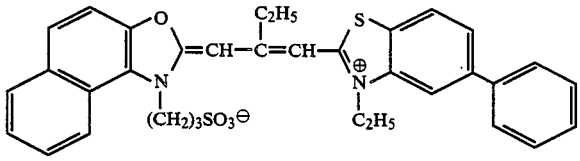
D-62
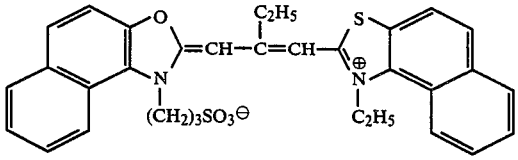
D-63
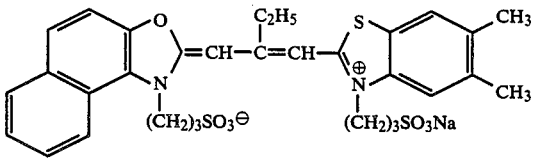
D-64
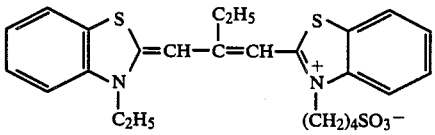
D-65
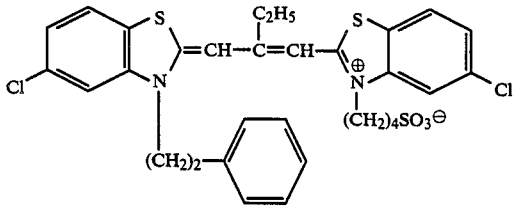
D-66
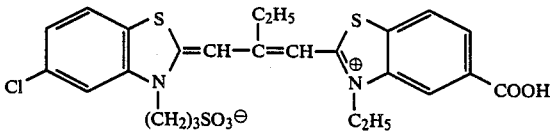

-continued
D-67
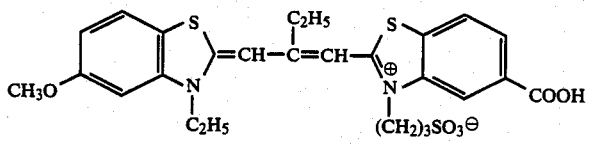
D-68
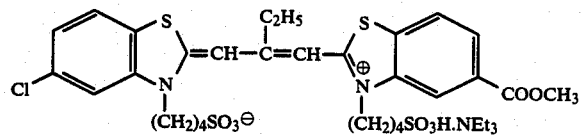
D-69
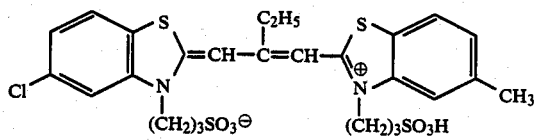
D-70
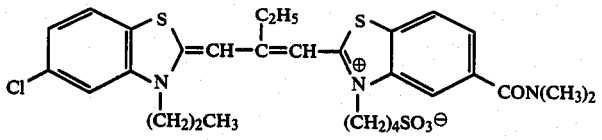
D-71
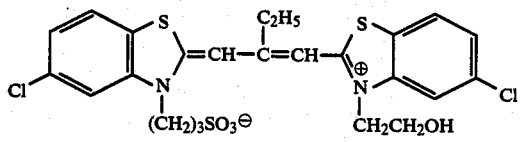
D-72
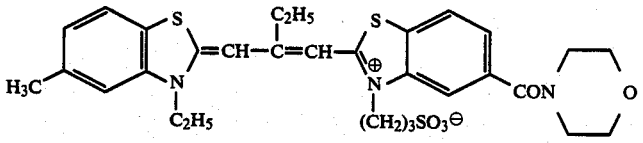
D-73
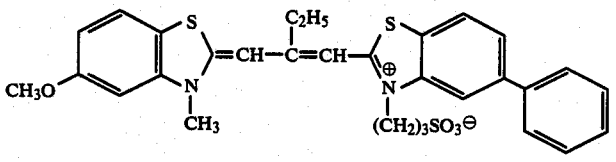
D-74
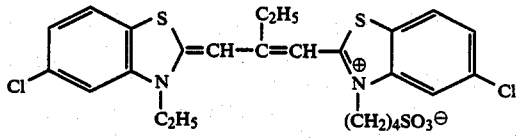
D-75
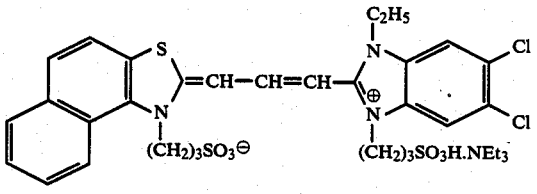
D-76
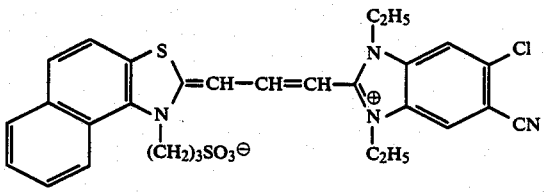

-continued
D-77
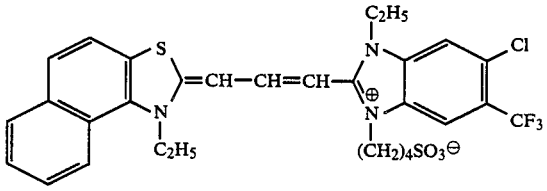
D-78
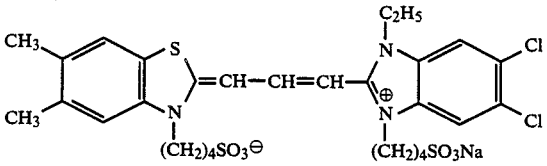
D-79
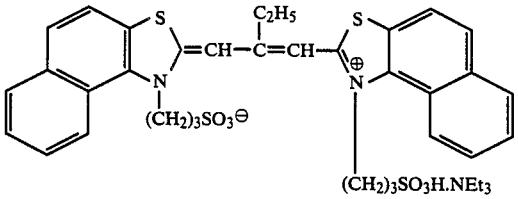
D-80
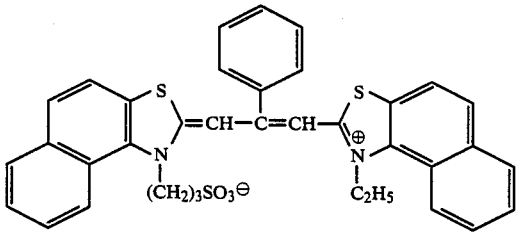
D-81
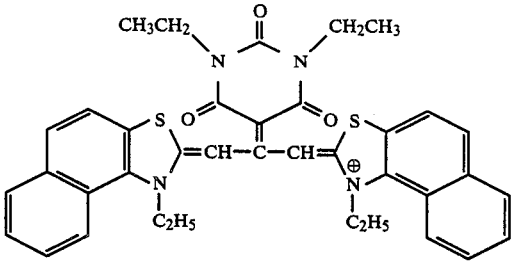
D-82
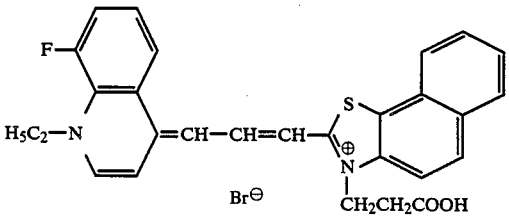
D-83
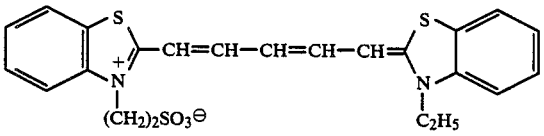
D-84
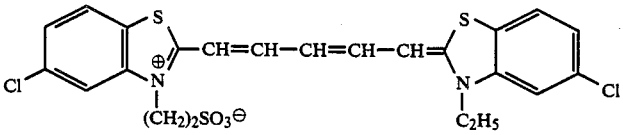

-continued
D-85
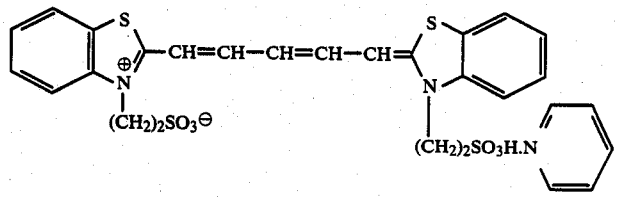
D-86
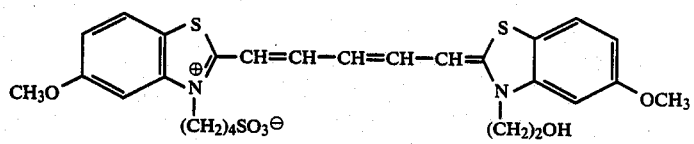
D-87
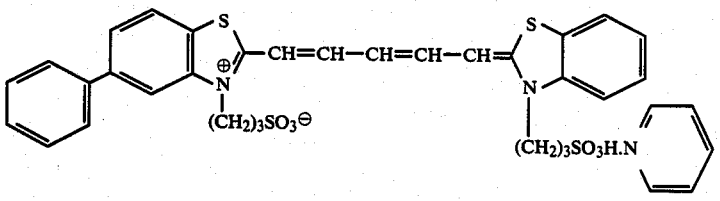
D-88
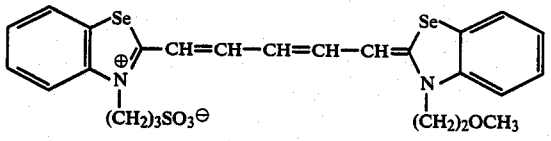
D-89
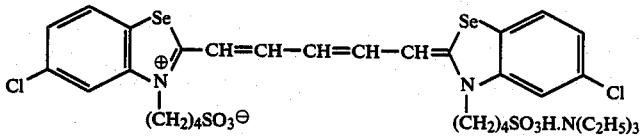
D-90
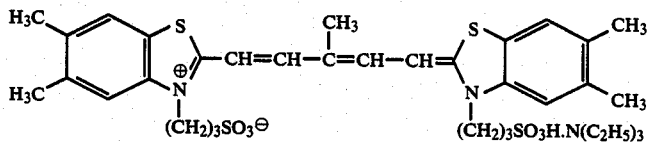
D-91
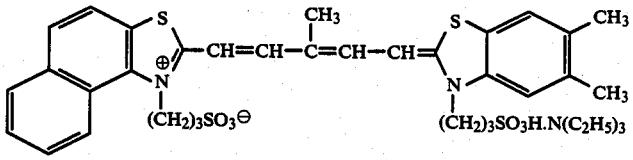
D-92
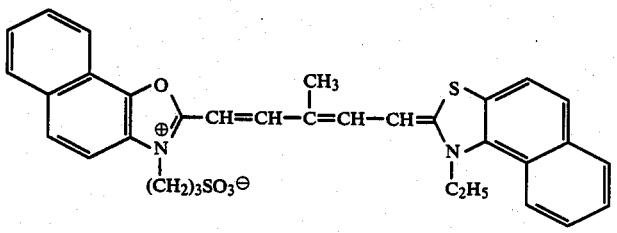
D-93
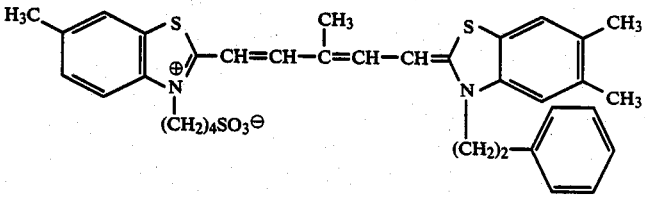

-continued

D-94

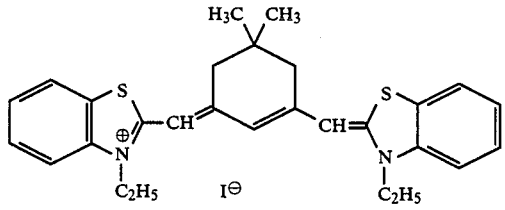

D-95

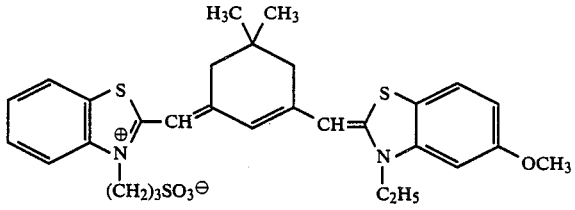

D-96

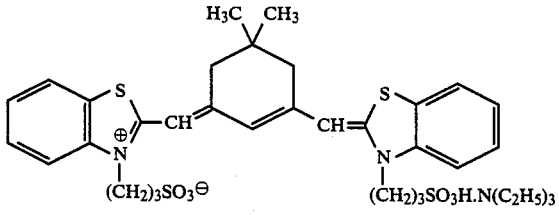

D-97

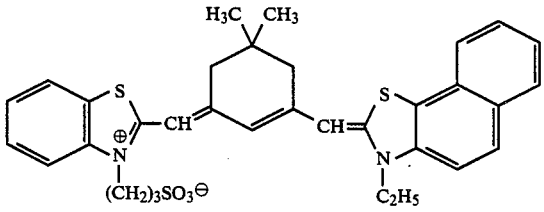

D-98

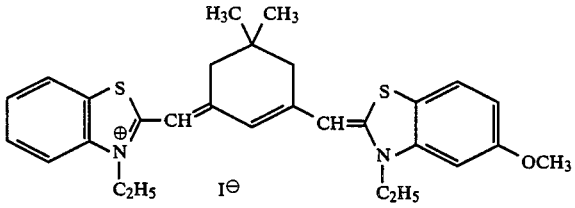

Of these cyanine dyes, those having a benzothiazole nucleus or a benzoxazole nucleus are particularly preferred.

In general, a method for adsorbing a spectrally sensitizing dye to the silver halide grain surface after complete formation of silver halide grains has been employed for spectral sensitization of silver halide emulsions. On the other hand, U.S. Pat. No. 2,735,766 discloses the possibility of decreasing the number of unadsorbed dye molecules by adding a merocyanine dye during the precipitation of silver halide grains. In addition, Japanese Patent Application (OPI) No. 26589/80 discloses a method of adding a spectrally sensitizing dye during the addition of silver salt and aqueous halide solutions for forming silver halide grains for the purpose of efficient adsorption of the spectrally sensitizing dye to the silver halide grain surface. These methods aim at strengthening the adsorbing power of spectrally sensitizing dyes on silver halide grains by introduction of the spectrally sensitizing dyes during the time silver halide grains are being formed, that is to say, at the increasing stage of the concentration of silver ions present as silver halide grain. Therefore, there is no point in adding a spectrally sensitizing dye after the conclusion of the grain formation.

The cyanine dyes may be added at any time in the present invention, provided that the addition can produce such a condition that the dyes have already been adsorbed on the silver halide grain surface at the stage of causing halogen replacement in the silver halide grains by the addition of a water-soluble bromide. Accordingly, when the halogen replacement is carried out immediately after the grain formation, it is preferred to add the cyanine dyes during the grain formation. On the other hand, the cyanine dyes may be added after the conclusion of grain formation when the halogen replacement is carried out after the lapse of a certain period from the time of grain formation. Moreover, the cyanine dyes may be added simultaneously with or subsequently to the addition of a water-soluble bromide to cause the halogen replacement, provided that the addition time of the cyanine dyes is before the conclusion of the halogen replacement. The cyanine dyes and the water-soluble bromide may be added all at once in a short time, or continuously taking much time. Further, the addition time of the cyanine dyes and that of the water-soluble bromide may overlap each other. Each of the additives may be divided into two or more fractions, and the fractions may be added in turn. Also, two kinds of fractions may be added alternately. In adding the cyanine dyes, they may take a form of water solution similarly to the water-soluble bromide. However, it is more preferable to add the cyanine dyes in a form of solution in which they are dissolved in an organic solvent such as an alcohol containing from 1 to 3 carbon atoms, acetone or the like, or in a form of liquid prepared by micell dispersion using a surface active agent, or so on.

An amount of the cyanine dyes to be added, though depends upon the quality of spectral sensitization required, should be determined by considering a quantity of halogen ions replaced, conditions for the replacement, and the like. A ratio of the cyanine dyes to the total silver halides ranges generally from $1\times10^{-5}$ to $4\times10^{-3}$ by mol, and preferably from $3\times10^{-5}$ to $2\times10^{-3}$ by mol.

The present invention makes it necessary to employ a monodispersed silver chlorobromide or silver chloride emulsion having a grain size distribution represented by a variation coefficient of 0.2 or less as the emulsion to undergo halogen replacement in the presence of a cyanine dye. This is because in the emulsion having a variation coefficient of above 0.2 with respect to the grain size distribution each grain is appreciably different from every other grains in progressing state of the halogen replacement, which does not bring about good results. In addition, silver chlorobromide or silver chloride emulsions to be employed in the present invention have substantially no iodide content. However, they may contain silver iodide in a fraction of 3 mol% or less, if desired. The silver halide grains to be employed prior to the halogen replacement may be uniform throughout the halogen composition, or the interior and the surface of the grains may differ in halide composition. Further, the grains may have a junction structure by epitaxial over growth or a multilayer structure. Also, such grains may be present in a mixed state. More specifically, silver chlorobromide grains constructed by different phases may have a core, or one or more of a layer, which is rich in bromide content in comparison with the average halogen composition, inside the individual grains. Contrary to this case, they may be grains having a core or a layer rich in a chloride content, compared with the average halogen composition. In any case, the grains which have received halogen replacement come to have, in at least a part of the surface layer, a new phase differing in halogen composition from the interior or the other part of the surface layer.

The mean grain size of silver halide grains (the mean grain size being determined with a grain diameter in those grains which are spherical or nearly spherical, and an edge length in those grains which are cubic as a grain size, and is expressed as a mean value calculated from projected area) preferably ranges from 0.1 μm to 2.2 μm, and particularly preferably from 0.2 μm to 1.2 μm.

The degree of the monodispersion which is represented by a variation coefficient (corresponding to the value of the standard deviation of the grain distribution curve of the silver halide grains as divided by the average grain size) is preferably 0.15 or less, more preferably 0.10 or less.

For the purpose of providing the desired gradation to the photographic material, two or more monodispersed silver halide emulsions prepared in accordance with the present invention, which have substantially the same color sensitivity but differ in grain size, may be coated as a mixture in a single layer or may be coated independently in separate layers. Provided that they have substantially the same color sensitivity, the emulsion of the present invention may be used with other monodispersed emulsions as a mixture or in combination, and they are coated in a single layer or in separate layers. Further, the emulsion of the present invention may be used together with polydispersed emulsions. In this case also, they may be coated in a single layer as a mixture or in a multilayer structure independently.

The silver halide grains of the present invention preferably have a regular crystal form, such as that of a cube, an octahedron, a dodecahedron, a tetradecahedron or so on. However, they may have an irregular form like a sphere, or a composite form of two or more of the above-cited crystal forms, provided that they have a monodispersed size distribution. Moreover, the grains may have a tabular form. An emulsion in which tabular silver halide grains having a diameter to thickness ration of 5 or more, particularly 8 or more, are contained in a fraction of 50% or more based on the total projected area of grains present therein may be employed. Also, an emulsion in which silver halide grains having different kinds of crystal forms as described above are present as a mixture may be used. These various emulsions may be emulsions of the kind which form latent image predominantly at the surface of the grains (surface latent image type), or emulsions of the kind which mainly form latent image inside the grains (internal latent image type).

These photographic emulsions can be prepared using various methods as described in, e.g., P. Glafkides, *Chimie et Photographique,* Paul Montel, Paris (1967); G. F. Duffin, *Photographic Emulsion Chemistry,* The Focal Press, London (1966); V. L. Zelikman et al., *Making and Coating Photographic Emulsion,* The Focal Press, London (1964) and so on. More specifically, any methods, e.g., the acid method, the neutral method, the ammonia method, and so on, can be employed.

Suitable methods for reacting a water-soluble silver salt with a water-soluble halide include, e.g., a single jet method, a double jet method, or a combination thereof.

Also, a method in which silver halide grains are produced in the presence of excess silver ion (the so-called reverse mixing method) can be employed. Moreover, the so-called controlled double jet method, in which the pAg of the liquid phase in which silver halide grains are to be precipitated is maintained constant, may be employed. According to this method, silver halide emulsions having a regular crystal form and an almost uniform grain size can be obtained.

Additives which can be used in the production of the silver halide emulsion according to the present invention are described below.

At the time of forming silver halide grains in accordance with the present invention, silver halide solvents, such as ammonia, potassium rhodanide, ammonium rhodanide, thioether compounds (e.g., those described in U.S. Pat. Nos. 3,271,157, 3,574,628, 3,704,130, 4,297,439 and 4,276,374, and so on), thione compounds (e.g., those described in Japanese patent application (OPI) Nos. 144319/78, 82408/78 and 77737/80, and so on), amine compounds (e.g., those described in Japanese patent application (OPI) No. 100717/79, and so on), and so on, can be used for the purpose of controlling the grain growth.

In a process of producing silver halide grains or allowing the produced silver halide grains to ripen physically, cadmium salts, zinc salts, thallium salts, iridium salts or complexes, rhodium salts or complexes, iron salts or complexes, and the like may be present.

As the chemical sensitization, sulfur sensitization is preferably carried out in the present invention.

Sulfur sensitization can be carried out using a conventional sulfur sensitization process. Specifically, it can be effected by using a sulfur-containing compounds capable of reacting with silver ion (e.g., thiosulfates, thioureas, mercapto compounds, rhodanines, etc.). Details of sulfur sensitization are described in U.S. Pat. Nos. 2,410,689 and 3,501,313, West German patent No. 1,422,869, Japanese patent publication No. 20533/74, and so on.

It is desirable to use a sulfur sensitizer in an amount ranging from about $10^{-8}$ to $5\times10^{-4}$ mol per mol of silver halide. The sensitization (ripening) is carried out preferably at a temperature of about 45° C. to 75° C. over a period of about from 5 minutes to 120 minutes.

Further, other sensitization methods can be employed in combination with sulfur sensitization.

Namely, reduction sensitization using reducing materials (e.g., stannous salts, amines, hydrazine derivatives, formamidinesulfinic acid, silane compounds, etc.) and noble metal sensitization using noble metal compounds (e.g., gold complex salts, complex salts of Group VIII in the Periodic Table, such as platinum, iridium, palladium, etc.) can be employed.

Details of reduction sensitization methods and noble metal sensitization methods are described, e.g., in U.S. Pat. Nos. 2,399,083, 2,597,856, 2,597,915, 2,487,850 and 2,518,698 and so on.

The photographic emulsion according to the present invention can contain a wide variety of compounds for purposes of preventing fog or stabilizing photographic functions during production, storage, or photographic processing. Specific examples of such compounds include azoles such as benzothiazolium salts, nitroindazoles, triazoles, benzotriazoles and benzimidazoles (especially those that are nitro- or halogen-substituted); heterocyclic mercapto compounds such as mercaptothiazoles, mercaptobenzothiazoles, mercaptobenzimidazoles, mercaptothiadiazoles, mercaptotetrazoles (especially 1-phenyl-5-mercaptotetrazole), and mercaptopyrimidines; heterocylic mercapto compounds as set forth above which contain additionally a water-soluble group such as a carboxyl group, a sulfo group, etc.; thioketo compounds like oxazolinethione; azaindenes such as tetraazaindenes (especially 4-hydroxy-substituted (1,3,3a,7)tetrazaindenes); and compounds which have been known as antifoggants or stabilizers such as benzenethiosulfonic acid, benzenesulfinic acid, and so on.

The silver halide photographic emulsion according to the present invention can contain color couplers such as a cyan coupler, a magenta coupler, a yellow coupler, etc., and a compound for dispersing these couplers into the emulsion.

Such compounds are capable of forming colors by coupling with the oxidation product of an aromatic primary amine developing agent (e.g., phenylenediamine derivatives, aminophenol derivatives, etc.) upon color development processing. Specific examples of magenta couplers which can be used include 5-pyrazolone couplers, pyrazoloazole couplers, and so on. Specific examples of yellow couplers which can be used include acylacetamide couplers (e.g., benzoylacetanilides, pivaloylacetanilides, etc.), and so on. Specific examples of cyan couplers which can be used include naphthol couplers and phenol couplers. Of these couplers, nondiffusible couplers which contain a hydrophobic group as a so-called ballast group in a molecule are more advantageous. The couplers may be either 4-equivalent or 2-equivalent with respect to silver ions. In addition, colored couplers which have a color correcting effect, and couplers capable of releasing development inhibitors upon development (so-called DIR couplers) may be incorporated in the photographic emulsion layers. Besides DIR couplers, colorless DIR coupling compounds which form colorless products upon the coupling reaction and release development inhibitors can also be incorporated.

The photographic emulsions prepared in accordance with the present invention may contain, for example, polyalkylene oxides and derivatives thereof, such as the ethers, the esters and the amines thereof, thioether compounds, thiomorpholines, quaternary ammonium salt compounds, urethane derivatives, urea derivatives, imidazole derivatives, 3-pyrazolidones, and so on in order to increase the sensitivity and the contrast, or in order to accelerate the developing rate thereof.

The silver halide photographic emulsion prepared in accordance with the present invention may contain known water-soluble dyes (e.g., oxonol dyes, hemioxonol dyes, and merocyanine dyes) as filter dyes, or dyes for preventing irradiation or for various other purposes. Further, known cyanine dyes, known merocyanine dyes, known hemicyanine dyes, and so on may be used additionally as spectral sensitizers before, during, or after chemical sensitization.

The photographic emulsion of the present invention may contain various kinds of surface active agents for a wide variety of purposes, for instance, as a coating aid, prevention of electrification, improvement in slippability, emulsifying dispersion, prevention of adhesion, improvement in photographic characteristics (e.g., acceleration of development, increase in contrast, sensitization, etc.) and so on.

Discoloration inhibitors, hardeners, colored fog inhibitors, ultraviolet absorbing agents, protective colloids like gelatin, and other additives which can be used for the photographic material of the present invention are described in detail in *Research Disclosure,* Vol. 176, RD No. 17643 (December, 1978), and so on.

The finished emulsion is coated on an appropriate support, such as a sheet of baryta paper, resin-coated paper or synthetic paper; a film of cellulose triacetate, polyethylene terephthalate, or like plastics; or glass plate.

The silver halide photographic material produced in accordance with the present invention can be utilized as a color positive film, a color paper, a color negative film, a color reversal film (with or without couplers), a photographic material for photomechanical use (e.g., lith film, lithdupe film, etc.), a photosensitive material for cathode ray tube display, a photosensitive material for X-ray recording a photosensitive material for the silver salt diffusion transfer process, a photosensitive material for the color diffusion transfer process, a photosensitive material for the dye transfer process (including imbibition transfer process), an emulsion for the silver dye bleach process, a photosensitive material for recording print-out images, a light-developable type printing-out (direct print image) photosensitive material, a heat-developable photosensitive material, a physically developable photosensitive material, and so on.

The exposure for obtaining a photographic image may be carried out in a conventional manner. Any of various known light sources, including natural light (sunlight), a tungsten lamp, a fluorescent lamp, a mercury lamp, a xenon arc lamp, a carbon arc lamp, a xenon flash lamp, cathode-ray tube flying spot and so on can be employed for the exposure. Suitable exposure times which can be used include not only an exposure time used commonly in cameras ranging from about 1/1,000 to about 1 sec., but also exposure times shorter than 1/1,000 sec., for example, about $1/10^4$ to about $1/10^6$ sec., as used with xenon flash lamps and cathode-ray tubes. Exposure times longer than 1 sec. can also be used. The spectral composition of the light employed for exposure can be controlled by using color filters, if desired. Laser beams can also be employed for the exposure. Moreover, the photographic material of the present invention may also be exposed to light emitted from phosphors excited by electron beams, X-rays $\gamma$-rays, $\alpha$-rays, and the like.

The photographic processing for the photographic material of the present invention can be effected using any known processing method and any known processing solution as described, e.g., in *Research Disclosure,* RD No. 17643 (December, 1978), pp. 28–30. The photographic processing may be either a photographic processing for forming a silver image (black-and-white photographic processing) or a photographic processing for forming a color image (color photographic processing). The processing temperature is generally in the range of about 18° C. to about 50° C. Of course, temperatures higher than 50° C. or lower than 18° C. may be employed.

The present invention is now illustrated in greater detail by reference to the following examples, which, however, are not to be construed as limiting the present invention in any way. Unless otherwise indicated, all percents, parts and ratios are by weight.

EXAMPLE 1

30 g of lime-processed gelatin was added to 1,000 ml of distilled water, and dissolved therein by warming it to 40° C. Thereto, 6.5 g of sodium chloride was added, and heated to 75° C. Then, both a solution containing 62.5 g of silver nitrate in 750 ml of distilled water and a solution containing 30.6 g of potassium bromide and 6.5 g of sodium chloride in 500 ml of distilled water were added dropwise to the above-described gelatin solution with stirring over a period of 40 minutes as a temperature of the mixture was kept at 75° C. To the resulting dispersion were further added a solution containing 62.5 g of silver nitrate in 500 ml of distilled water and a solution containing 30.6 g of potassium bromide and 6.5 g of sodium chloride in 300 ml of distilled water over a period of 20 minutes under a temperature maintained at 75° C. After the lapse of 10 minutes from the conclusion of the addition, a solution containing 4.4 g of potassium bromide dissolved in 50 ml of distilled water was added, and the stirring was further continued for 10 minutes. Then, the resulting emulsion was desalted and washed with water, and further subjected to chemical ripening by adding thereto 6 mg of sodium thiosulfate and keeping it at 60° C. for 40 minutes. After addition of Sensitizing Dye D-29 illustrated hereinbefore ($3\times10^{-4}$ mol/mol Ag), the thus-obtained emulsion (having a variation coefficient of 0.12) was coated on a cellulose triacetate base so as to have a silver coverage of 2.3 g/m$^2$ and a gelatin coverage of 3.3 g/m$^2$ to prepare Sample A.

Another emulsion was made in the same manner as the emulsion used for producing Sample A except that $3\times10^{-4}$ mol/mol Ag of Sensitizing Dye D-29, was added after the lapse of 3 minutes from the conclusion of the second addition of the silver and halogen salts instead of after the chemical ripening, and coated on a cellulose triacetate base at the same silver coverage as Sample A to produce Sample B.

Samples C, D, E and F were produced in the same manner as Sample B, except that amounts of potassium bromide added after the lapse of 10 minutes from the conclusion of the second addition of silver and halogen salts were changed from 4.4 g to 0.3 g, 0.9 g, 10.6 g and 26.3 g, respectively.

Each of these Samples A to F was exposed to white light of 5,400° K. for 0.5 second through an optical wedge, and developed at 20° C. for 10 minutes using a developing solution having the following composition. Photographic densities were measured, and the results obtained are shown in Table 1.

| Composition of Developing Solution: | |
|---|---|
| Ascorbic Acid | 10 g |
| p-Methylaminophenol | 2.4 g |
| Sodium Carbonate | 10 g |
| Potassium Bromide | 1 g |
| Water to make | 1 liter |

TABLE 1

| Sample | Potassium Bromide | Cyanine Dye (upon replacement) | Sensitivity | Fog | Pressure Desensitization | Pressure Mark | Remark |
|---|---|---|---|---|---|---|---|
| A | 4.4 g (5 mol %) | — | 100 | 0.02 | 91 | 0.42 | Comparison |
| B | 4.4 g (5 mol %) | D-29 ($3\times10^{-4}$ mol/mol Ag) | 121 | 0.02 | 97 | 0.09 | Invention |
| C | 0.3 g (0.3 mol %) | D-29 ($3\times10^{-4}$ mol/mol Ag) | 89 | 0.02 | 100 | 0.50 | Comparison |
| D | 0.9 g (1 mol %) | D-29 ($3\times10^{-4}$ mol/mol Ag) | 107 | 0.02 | 97 | 0.13 | Invention |
| E | 10.6 g (12 mol %) | D-29 ($3\times10^{-4}$ mol/mol Ag) | 126 | 0.02 | 87 | 0.07 | Invention |
| F | 26.3 g (30 mol %) | D-29 ($3\times10^{-4}$ mol/mol Ag) | 123 | 0.02 | 74 | 0.02 | Comparison |

The sensitivity was expressed in terms of the relative value of a reciprocal of an exposure amount required for providing a density of fog +0.5, taking the sensitivity of Sample A as 100. The criterion for pressure desensitization was made as follows: Each sample was folded at an angle of 90°, and then exposed and developed. The relative value of the density of 0.3 was set at 100. The density of the folded part was measured and the relative value thereof was calculated on the basis of the previously set relative value of 100. The pressure mark was expressed in terms of the density generated by folding each sample at an angle of 45°.

Sample A, in which the emulsion having received halogen replacement in the absence of the cyanine dye was used, tended to generate both pressure densensitization and pressure marks, while Sample B produced in accordance with the present invention had not only enhanced sensitivity, but also the desirable properties of reduced pressure desensitization and reduced pressure marks.

When the quantity of halogen ions replaced by bromine ion was small even though the cyanine dye was present, the sensitivity was rather low, and pressure marks liable to be produced through pressure desensitization did not occur. On the other hand, when a quantity of halogens to be replaced was large, the sensitivity was high and pressure marks were not produced, but pressure desensitization was caused to a great extent. It can be seen from these results that only the samples produced in accordance with the present invention had high sensitivity, and made it feasible to control the pressure desensitization and pressure marks to such a low level as not to cause any problems upon practical use.

EXAMPLE 2

30 g of lime-processed gelatin was added to 1,000 ml of distilled water, and dissolved therein by warming it to 40° C. Thereto, 6.5 g of sodium chloride was added, and heated to 70° C. Then, both a solution containing 62.5 g of silver nitrate in 750 ml of distilled water and a solution containing 21.9 g of potassium bromide and 10.8 g of sodium chloride in 500 ml of distilled water were added dropwise to the above-described gelatin solution with stirring over a period of 40 minutes as a temperature of the mixture was kept at 70° C. To the resulting dispersion were further added a solution containing 62.5 g of silver nitrate in 500 ml of distilled water and a solution containing 21.9 g of potassium bromide and 10.8 g of sodium chloride in 300 ml of distilled water over a period of 20 minutes under a temperature maintained at 70° C. After the lapse of 5 minutes from the conclusion of the addition, a solution containing 3.5 g of potassium bromide dissolved in 50 ml of distilled water was added, and the stirring was further continued for 5 minutes. Then, the resulting emulsion was desalted and washed with water, and further subjected to chemical ripening by adding thereto 4.8 mg of sodium thiosulfate and keeping it at 60° C. for 40 minutes. To the thus obtained emulsion (having a variation coefficient of 0.12) was added $3\times10^{-4}$ mol/mol Ag of Sensitizing Dye D-30. The resulting emulsion was coated on a cellulose triacetate base so as to have a silver coverage of 2.3 g/m$^2$ and a gelatin coverage of 3.3 g/m$^2$ to prepare Sample G.

Emulsions were made in the same manner as the emulsion used for producing Sample G, except that Sensitizing Dye D-30 described above was added in amounts of $0.75\times10^{-4}$, $1.5\times10^{-4}$, and $3\times10^{-4}$ mol/mol Ag, respectively, 5 minutes before the conclusion of the second addition of the siler and halogen salts, and Dye D-30 was further added prior to the coating in amounts of $2.25\times10^{-4}$, $1.5\times10^{-4}$, and 0 mol/mol Ag, respectively. These emulsions each was coated on a cellulose triacetate base so as to have the same silver coverage as Sample G. Thus, Sample H, Sample I, and Sample J were produced. These were subjected to the same exposure and processing to produce results as shown in Table 2.

TABLE 2

| Sample | Potassium Bromide | Cyanine Dye (upon replacement) | Sensitivity | Fog | Pressure Desensitization | Pressure Mark | Remark |
|---|---|---|---|---|---|---|---|
| G | 3.5 g (4 mol %) | — | 100 | 0.02 | 83 | 0.63 | Comparison |
| H | " | D-30 ($0.75\times10^{-4}$ mol/mol Ag) | 115 | 0.02 | 93 | 0.26 | Invention |
| I | " | D-30 ($1.5\times10^{-4}$ mol/mol Ag) | 121 | 0.02 | 95 | 0.14 | Invention |
| J | " | D-30 ($3\times10^{-4}$ mol/mol Ag) | 123 | 0.02 | 97 | 0.08 | Invention |

Every sample which had undergone the halogen replacement in the presence of a cyanine dye in accordance with the present invention has proved to have high sensitivity and to succeed in reduction of pressure desensitization and pressure marks.

EXAMPLE 3

An emulsion was prepared in the same manner as the emulsion used for producing Sample A in Example 1, except that no sensitizing dye was added, and coated similarly to produce Sample K. In addition, Samples L to T were produced in the same manner as Sample B except that the sensitizing dye added to the emulsion was changed from Sensitizing Dye D-29 to those set forth in Table 3, respectively, and no sensitizing dye except the dye shown in Table 3 was added. These samples were subjected to the same exposure and development processings to produce the results set forth in Table 3. Since different kinds of sensitizing dyes were used in this example, there is no meaning in direct comparison of the sensitivities obtained. Therefore, only the results with respect to pressure desensitization and pressure marks are given in Table 3.

The pressure desensitization of each sample was expressed in terms of the relative value of sensitivity attained by the pressure-applied sample, with the sensitivity of the sample free of pressure being taken as 100.

TABLE 3

| Sample | Cyanine Dye | Amount Added (mol/mol Ag) | Pressure Desensitization | Pressure Mark | Remark |
|---|---|---|---|---|---|
| K | — | — | 82 | 0.36 | Comparison |
| L | D-22 | $1\times10^{-4}$ | 92 | 0.18 | Invention |
| M | D-22 | $3\times10^{-4}$ | 96 | 0.13 | " |
| N | D-22 | $6\times10^{-4}$ | 92 | 0.11 | " |
| O | D-24 | $3\times10^{-4}$ | 97 | 0.15 | " |
| P | D-10 | $3\times10^{-4}$ | 94 | 0.14 | " |
| Q | D-59 | $3\times10^{-4}$ | 94 | 0.16 | " |
| R | D-74 | $3\times10^{-4}$ | 97 | 0.12 | " |
| S | D-94 | $3\times10^{-5}$ | 88 | 0.22 | " |
| T | D-95 | $3\times10^{-5}$ | 90 | 0.20 | " |

Satisfactory decreases in both pressure desensitization and pressure marks were observed in the samples of the present invention.

For the purpose of comparison, Samples U to X were produced using emulsions prepared in the same manner as those for Samples K to N, respectively, except that the step of halogen replacement was omitted, that is, potassium bromide was not added in an interval between addition of the sensitizing dye and chemical ripening. These samples also were examined in the same way as Samples K to N. The results obtained are set forth in Table 4.

TABLE 4

| Sample | Sample to Be Compared | Sensitivity | Pressure Desensitization | Pressure Mark | Remark |
|---|---|---|---|---|---|
| U | K | 78 | 100 | 0.60 | Comparison |
| V | L | 75 | 100 | 0.63 | " |
| W | M | 71 | 103 | 0.65 | " |
| X | N | 73 | 106 | 0.61 | " |

All of these samples had low sensitivities, and were apt to generate pressure marks although they did not cause pressure desensitization. In addition, these results indicate that the effects of the present invention cannot be achieved without the halogen replacement, that is to say, with a cyanine dye alone.

EXAMPLE 4

On a paper support laminated with polyethylene on the both sides were coated first to seventh constituent layers described below in order to prepare a color photographic material. The polyethylene laminate on which the first layer was coated contained titanium dioxide and a slight amount of ultramarine.

The number corresponding to each ingredient in the following description represents a coverage expressed in g/m$^2$. As for the silver halide emulsions, their coverages are based on silver.

| First Layer (Blue-Sensitive Layer) | |
|---|---|
| Silver chlorobromide emulsion (silver bromide: 80 mol %) | 0.30 (silver) |
| Yellow coupler (*1) | 0.70 |
| Solvent for yellow coupler (TNP) | 0.15 |
| Gelatin | 1.20 |
| **Second Layer (Interlayer)** | |
| Gelatin | 0.90 |
| Di-t-octylhydroquinone | 0.05 |
| Solvent for the above ingredient (DBP) | 0.10 |
| **Third Layer (Green-Sensitive Layer)** | |
| Silver chlorobromide emulsion (the same emulsion as employed for Sample K in Example 3) | 0.45 (silver) |
| Magenta coupler (*2) | 0.35 |
| Solvent for magenta coupler (TOP) | 0.44 |
| Discoloration inhibitor (*3/*4) | 0.05/0.10 |
| Gelatin | 1.00 |
| **Fourth Layer (Ultraviolet Absorbing Interlayer)** | |
| Ultraviolet absorbent (*5/*6/*7) | 0.06/0.25/0.25 |
| Solvent for the above ingredient (TNP) | 0.20 |
| Gelatin | 1.5 |
| **Fifth Layer (Red-Sensitive Layer)** | |
| Silver chlorobromide emulsion (the same emulsion as employed for Sample K in Example 3) | 0.20 (silver) |
| Cyan coupler (*8/*9) | 0.2/0.2 |
| Coupler solvent (TNP/DBP) | 0.10/0.20 |
| Gelatin | 0.9 |
| **Sixth Layer (Ultraviolet Absorbing Interlayer)** | |
| Ultraviolet absorbent (*5/*6/*7) | 0.06/0.25/0.25 |
| Solvent for the above ingredient (DBP) | 0.20 |
| Gelatin | 1.5 |
| **Seventh Layer (Protective Layer)** | |
| Gelatin | 1.5 |

Herein, DBP, TOP, and TNP represent dibutyl phthalate, tri(n-octyl)phosphate, and tri(n-nonyl)phosphate, respectively.

(*1)

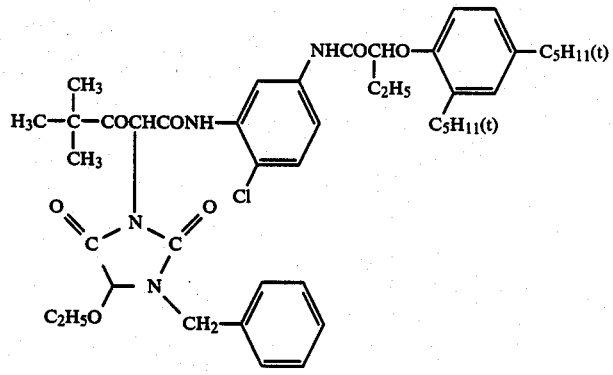

(*2)

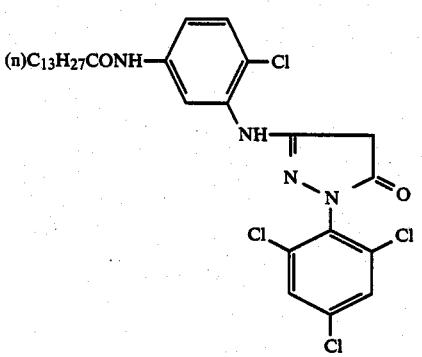

(*3)

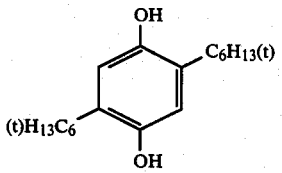

-continued (*4)

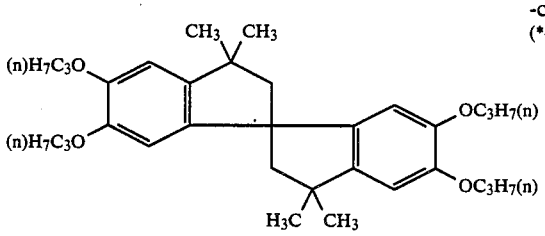

(*5)

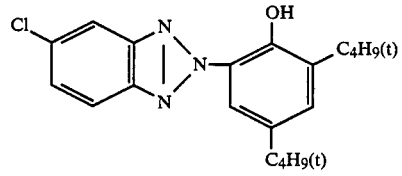

(*6)

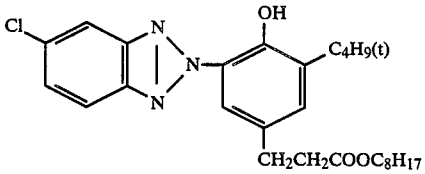

(*7)

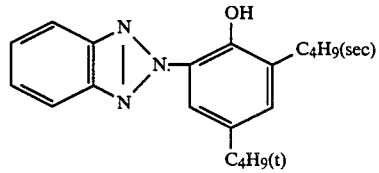

(*8)

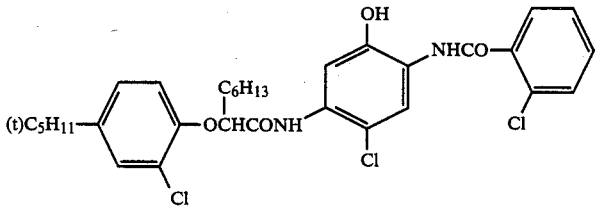

(*9)

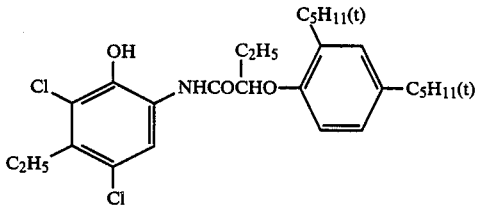

To the emulsion employed inthe first layer, Sensitizing Dye D-24 was added in an amount of $2\times10^{-4}$ mol per mol of silver halide at the time of coating.

To the emulsion employed in the third layer, Sensitizing Dye D-29 was added in an amount of $3\times10^{-4}$ mol per mol of silver halide at the time of coating.

To the emulsion employed in the fifth layer, Sensitizing Dye D-94 was added in an amount of $3\times10^{-5}$ mol per mol of silver halide at the time of coating.

As for the hardener for gelatin, sodium 2-hydroxy-4,6-dichloro-s-triazine was employed.

Further, 4-hydroxy-6-methyl(1,3,3a,7)tetraazaindene was added to each emulsion layer.

Furthermore, the following irradiation inhibiting dyes were incorporated in the green-sensitive emulsion layer and the red-sensitive emulsion layer, respectively.

Green-Sensitive Emulsion Layer:

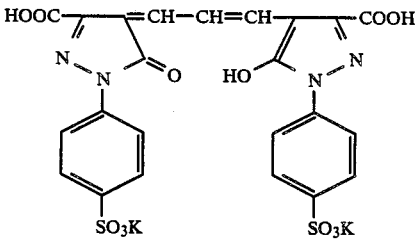

Red-Sensitive Emulsion Layer:

-continued

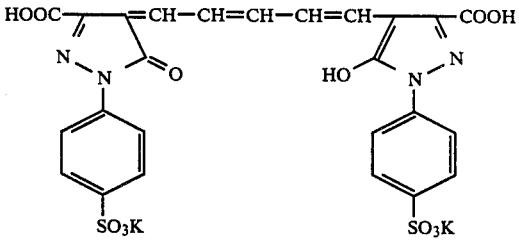

The sample having the above-described constituent layers was named Sample Y. Another sample was produced in the same manner as Sample Y, except that the same emulsion as used in Sample B of Example 1 was substituted for the emulsion of the third layer, and the same emulsion as used in Sample S was substituted for the emulsion of the fifth layer. This sample was designated as Sample Z. However, the sensitizing dyes added at the time of coating for producing Sample Y were not added in Sample Z.

These samples were exposed to light for 0.5 second through an optical wedge, and then subjected to the following processings to bring about the results shown in Table 5.

| Processing Step | Temperature (°C.) | Time |
|---|---|---|
| Color Development | 33 | 3 min 30 sec |
| Bleach-Fixing | 33 | 1 min 30 sec |
| Washing | 24–34 | 3 min |

-continued

| Processing Step | Temperature (°C.) | Time |
|---|---|---|
| Drying | 80 | 1 min |

Compositions of the processing solutions used are as follows.

| | |
|---|---|
| **Color Developing Solution:** | |
| Water | 800 ml |
| Diethylenetriaminepentaacetic Acid | 3.0 g |
| Benzyl Alcohol | 15 ml |
| Diethylene Glycol | 10 ml |
| Sodium Sulfite | 2.0 g |
| Potassium Bromide | 0.5 g |
| Potassium Carbonate | 30.0 g |
| N—Ethyl-N—(8-methanesulfonamidoethyl)-3-methyl-4-aminoaniline Sulfate | 5.0 g |
| Hydroxylamine Sulfate | 4.0 g |
| Brightening Agent (4,4'-distilbene type) | 1.0 g |
| Water to make | 1,000 ml |
| pH adjusted (at 25° C.) to | 10.10 |
| **Bleach-Fixing Solution:** | |
| Water | 400 ml |
| Ammonium Thiosulfate (70% solution) | 150 ml |
| Sodium Sulfite | 18 g |
| Ammonium Ethylenediaminetetraacetato Ferrate(III) | 55 g |
| Disodium Ethylenediaminetetraacetate | 5 g |
| Water to make | 1,000 ml |
| pH adjusted (at 25° C.) to | 6.70 |

TABLE 5

| | Sample | Sensitivity | Fog | Pressure Desensitization | Pressure Mark | Remark |
|---|---|---|---|---|---|---|
| Y | Cyan color developed part | 100 | 0.09 | 93 | 0.21 | Comparison |
| | Magenta color developed part | 100 | 0.08 | 92 | 0.14 | |
| Z | Cyan color developed part | 112 | 0.09 | 97 | 0.09 | Invention |
| | Magenta color developed part | 118 | 0.08 | 100 | 0.08 | |

As can be seen from the results shown above, the sample of the present invention had higher sensitivity, and did not cause pressure desensitization and pressure marks, that is, had excellent properties.

EXAMPLE 5

Samples were prepared in the same manner as Sample A and Sample B, respectively, which were produced in Example 1, except that chemical sensitization was carried out using a combination of 6 mg of sodium thiosulfate and 4.2 mg of chloroauric acid in place of 6 mg of sodium thiosulfate alone. These were designated as Sample $A_1$ and Sample $B_1$, respectively. These samples were subjected to the same exposure and development processings as in Example 1 to produce the results shown in Table 6.

TABLE 6

| Sample | Sensitivity* | Fog | Pressure Desensitization | Pressure Mark | Remark |
|---|---|---|---|---|---|
| $A_1$ | 100 | 0.06 | 111 | 0.90 | Comparison |
| $B_1$ | 117 | 0.05 | 102 | 0.44 | Invention |

*Relative value, with Sample $A_1$ being taken as 100.

In this case also, the sample produced in accordance with the present invention has proved to be excellent.

EXAMPLE 6

A sample (designated as Sample $C_1$) was produced in the same manner as Sample A in Example 1, except that in the process of preparing the emulsion, the desalting and washing steps were carried out without going through the addition of the solution containing 4.4 g of potassium bromide dissolved in 50 ml of distilled water, followed by the chemical ripening at 60° C. for 40 minutes using 6 mg of sodium thiosulfate, and further, the amount of Sensitizing Dye D-29 added upon coating was changed to $1.5\times10^{-4}$ mol/mol Ag.

Another sample (designated as Sample $D_1$) was produced in the same manner as Sample $C_1$, except that in the course of the chemical sensitization with sodium thiosulfate at 60° C. for 40 minutes, a solution containing 1.0 g of potassium bromide dissolved in 10 ml of distilled water was added after the lapse of 3 minutes from the addition of sodium thiosulfate.

Other samples (designated as Sample $E_1$ and Sample $F_1$) were produced in the same manner as Sample $C_1$ and Sample $D_1$, respectively, except that $1.5\times10^{-4}$ mol/mol Ag of Sensitizing Dye D-29 was added 10 minutes before sodium thiosulfate was added, though chemical sensitization was carried out in the same manner, and any sensitizing dye was not added upon coating. Accordingly, Sample $F_1$ alone had received the halogen replacement and the chemical ripening at the same time.

These samples were subjected to the same exposure and development processings as in Example 1 to bring about the results shown in Table 7.

TABLE 7

| Sample | Sensitivity | Fog | Pressure Desensitization | Pressure Mark | Remark |
|---|---|---|---|---|---|
| $C_1$ | 100 | 0.02 | 96 | 0.66 | Comparison |
| $D_1$ | 176 | 0.02 | 92 | 0.53 | " |
| $E_1$ | 102 | 0.02 | 97 | 0.69 | " |
| $F_1$ | 202 | 0.02 | 94 | 0.44 | Invention |

The sensitivities are shown as relative values, with Sample $C_1$ being taken as 100.

The pressure densitization is expressed in terms of the relative sensitivity under applied pressure, with the sensitivity of each sample free of pressure being taken as 100.

As can be seen from the above results, the sample of the present invention had the highest sensitivity, and was excellent in pressure resistance also.

EXANPLE 7

30 g of lime-processed gelatin was added to 1,000 ml of distilled water, and dissolved therein by warming up to 40° C. Thereto, 6.5 g of sodium chloride was added, and heated up to 52.5° C. Then, both a solution containing 62.5 g of silver nitrate in 750 ml of distilled water and a solution containing 21.5 g of sodium chloride in 500 ml of distilled water were added to the above-described gelatin solution over a period of 40 minutes while the temperature of the mixture was kept at 52.5° C. To the resulting dispersion were further added a solution containing 62.5 g of silver nitrate in 500 ml of distilled water and a solution containing 21.5 g of sodium chloride in 300 ml of distilled water over a 20 minute period under a temperature maintained at 52.5° C. After the lapse of 10 minutes from the conclusion of the above addition, a solution containing 8.8 g of potassium bromide dissolved in 100 ml of distilled water was added, and stirred for additional 10 minutes. Thereafter, the thus obtained emulsion was desalted and washed with water. The resulting emulsion was chemically ripened with 3 mg of sodium thiosulfate at 60° C. for 40 minutes. Thereto, Sensitizing Dye D-29 was added under the same condition as Sample A in Sample 1. The emulsion thus obtained was coated under the same condition as in Example 1 to produce Sample G1.

Another emulsion was prepared in the same manner as the emulsion used for production of Sample G1, except that the amount of potassium bromide added after the lapse of 10 minutes from the conclusion of the second addition of the silver and halogen salts was reduced to 1/10. The emulsion was coated in a similar manner as above to produce Sample G2.

Emulsions were further prepared in the same manner as the emulsions used for producing Sample G1 and Sample G2, respectively, except that Sensitizing Dye D-29 was added after the lapse of 3 minutes from the conclusion of the second addition of the silver and halogen salts, by analogy with the emulsion used in Sample B of Example 1. These emulsions were coated to produce Sample G3 and Sample G4, respectively.

For further comparison, the following emulsions were prepared.

30 g of lime-processed gelatin was added to 1,000 ml of distilled water, and warmed to 40° C. for dissolution. Thereto, 6.5 g of sodium chloride was added, and heated to 55° C. Then, both a solution containing 62.5 g of silver nitrate in 750 ml of distilled water and a solution containing 4.4 g of potassium bromide and 19.4 g of sodium chloride in 500 ml of distilled water were added to the above-described gelatin solution over a period of 40 minutes as a temperature of the mixture was kept at 55° C. To the resulting dispersion were further added a solution containing 62.5 g of silver nitrate in 500 ml of distilled water and a solution containing 4.4 g of potassium bromide and 19.4 g of sodium chloride in 300 ml of distilled water over a period of 20 minutes under a temperature kept at 55° C. After the lapse of 3 minutes from the conclusion of the above addition, Sensitizing Dye D-29 was added, by analogy with the emulsion used in Sample B of Example 1. The emulsion thus obtained was coated to produce Sample G5.

Separately, 30 g of lime-processed galatin was added to 1,000 ml of distilled water, and warmed to 40° C. for dissolution. Thereto, 6.5 g of sodium chloride was added, and heated to 52.5° C. Then, both a solution containing 62.5 g of silver nitrate in 750 ml of distilled water and a solution containing 0.44 g of potassium bromide and 21.3 g of sodium chloride in 500 ml of distilled water were added to the above-described gelatin solution over a period of 40 minutes as a temperature of the mixture was kept at 52.5° C. To the resulting dispersion were further added a solution containing 62.5 g of silver nitrate in 500 ml of distilled water and a solution containing 0.44 g of potassium bromide and 21.3 g of sodium chloride in 300 ml of distilled water over a period of 20 minutes under a temperature kept at 52.5° C. After the lapse of 3 minutes from the conclusion of the above addition, Sensitizing Dye D-29 was added, by analogy with the emulsion used in Sample B of Example 1. The emulsion thus obtained was coated to produce Sample G6.

Furthermore, Sample G7 and Sample G8 were produced using emulsions prepared in the same manner as the emulsions used in Sample G3 and Sample G4, respectively except that the time for the addition of potassium bromide for halogen replacement and the time for the addition of Sensitizing Dye D-29 were reversed.

Grain size distributions of the emulsions used for producing Samples G1 to G8 had the following variation coefficients.

G1, G7: 0.12
G2, G3, G8: 0.11
G5: 0.10
G4, G6: 0.09

Samples G1 to G8 were optically exposed and developed in the same manner as in Example 1. Thus, the results shown in Table 8 were obtained.

The testing method and expressions of characteristics, such as sensitivity, employed in Example 1 applied correspondingly in the case of these samples. In order to make a comparison among the emulsions having the same bromide content, the samples were divided into two groups, with one group consisting of G1, G3, G5 and G7, and the other group consisting of G2, G4, G6 and G8. In Table 8, the sensitivities are shown as relative values, with Sample G1 and Sample G2 being taken as 100 in the respective groups.

TABLE 8

| Sample | Silver Bromide Content (mol %) | Bromide Ion Replaced (mol %) | Dye upon Replacement | Sensitivity | Fog | Pressure Desensitization | Pressure Mark | Remark |
|---|---|---|---|---|---|---|---|---|
| G1 | 10 | 10 | Absent | 100 | 0.03 | 34 | 0.13 | Comparison |
| G3 | 10 | 10 | D-29 | 182 | 0.03 | 84 | 0.05 | Invention |
| G5 | 10 | — | — | 49 | 0.03 | 98 | 0.48 | Comparison |
| G7 | 10 | 10 | Absent | 123 | 0.03 | 42 | 0.15 | Comparison |
| G2 | 1 | 1 | Absent | 100 | 0.04 | 76 | 0.16 | Comparison |
| G4 | 1 | 1 | D-29 | 214 | 0.03 | 96 | 0.04 | Invention |
| G6 | 1 | — | — | 68 | 0.03 | 98 | 0.35 | Comparison |
| G8 | 1 | 1 | Absent | 115 | 0.04 | 80 | 0.15 | Comparison |

The emulsions produced in accordance with the present invention not only had high sensitivity, but also were hard to cause both pressure desensitization and pressure marks, compared with the emulsions used in Sample G1 and Sample G7, in which the halogen replacement had been carried out in the absence of Sensitizing Dye D-29. From a comparison of Sample G5 with Sample G7, it is apparent that the effect of the present invention cannot be attributed to the halogen replacement alone. In addition, it is evident from a comparison of Sample G1 with Sample G7 that the effect of the present invention cannot be attributable to the way of adding the sensitizing dye.

As for the other sample of the present invention G4, its superiority is obvious from the comparison with the results of G2, G6 and G8.

EXAMPLE 8

Emulsions were prepared in the same manner as the emulsions used in Example 7 for producing Sample G2, Sample G4, Sample G6 and Sample G8, respectively, except that the addition of potassium bromide for the halogen replacement and the addition of Sensitizing Dye D-29 were not carried out before desalting and washing steps, but these addition steps were carried out 20 minutes and 27 minutes, respectively, before the sulfur sensitization. From the comparison among the results obtained by applying the same tests as in Example 7, the emulsion of the present invention, which corresponded to G4, was ascertained to be superior in sensitivity, pressure desensitization and pressure marks.

EXAMPLE 9

On a paper support laminated with polyethylene on both sides were coated the layers described in Table 9 to prepare a multilayer multicolor photographic printing paper. Coating compositions for forming constituent layers were prepared as follows:

Preparation of a coating composition for the first layer was illustrated in detail below.

To a mixture of 19.1 g of Yellow Coupler (a) and 4.4 g of Color Image Stabilizer (b) were added 27.2 ml of ethyl acetate and 7.9 ml of Solvent (c) to prepare a solution. This solution was dispersed, in an emulsified condition, into 185 ml of a 10% gelatin aqueous solution containing 8 ml of a 10% water solution of sodium dodecylbenzenesulfonate. Separately, a blue-sensitive sensitizing dye as illustrated below was added to a silver chlorobromide emulsion (bromide content: 1.0 mol%, silver content: 70 g per kg of emulsion) in an amount of $5.0\times10^{-4}$ mol per mol of silver. The resulting emulsion was mixed homogeneously with the foregoing emulsified dispersion so as to have the composition for the first layer described in Table 9.

By analogy with the first layer, second to seventh layers were prepared as indicated in Table 9.

In each of the layers, the sodium salt of 1-oxy-3,5-dichloro-s-triazine was used as a gelatin hardener.

Spectrally sensitizing dyes employed in emulsion layers sensitive to colors corresponding thereto are illustrated below:

Blue-Sensitive Emulsion Layer

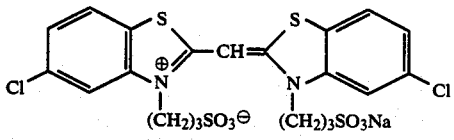

($5.0\times10^{-4}$ mol per mol of silver halide)

Green-Sensitive Emulsion Layer

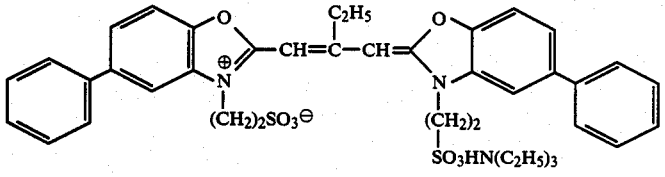

($4.0\times10^{-4}$ mol per mol of silver halide)

and

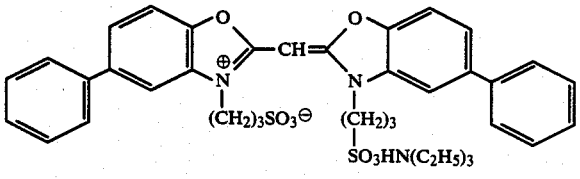

($7.0\times10^{-4}$ mol per mol of silver halide)

Red-Sensitive Emulsion Layer

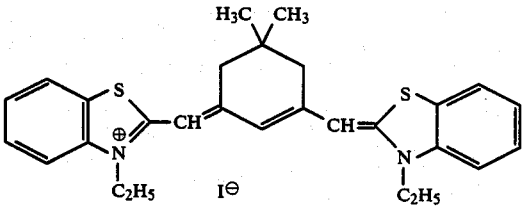

($0.9\times10^{-4}$ mol per mol of silver halide)

For the purpose of preventing an irradiation phenomenon from occurring, the dyes illustrated below were added to each emulsion layer.
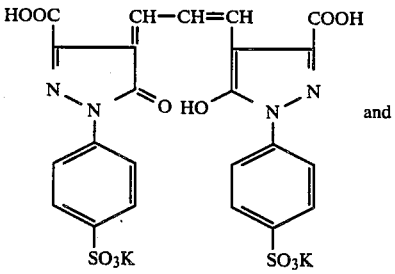
and
-continued
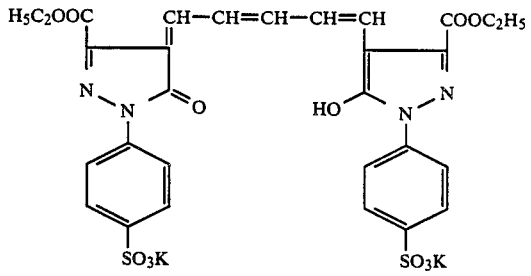
Structural formulae of the couplers and other additives used in this example are illustrated below.
(a) Yellow Coupler
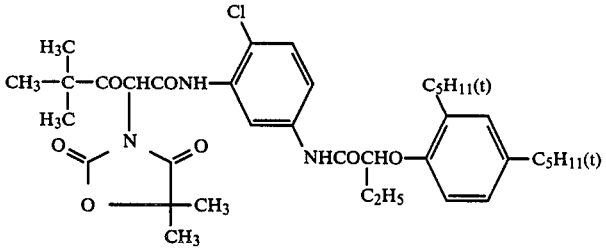
(b) Color Image Stabilizer
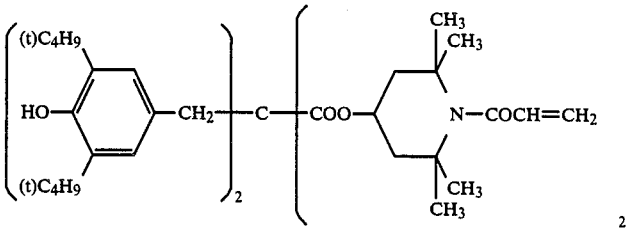
(c) Solvent
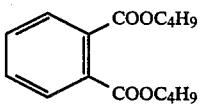
(d) Color Mixing Preventing Agent
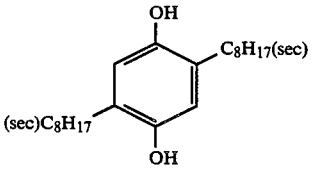
(e) Magenta Coupler
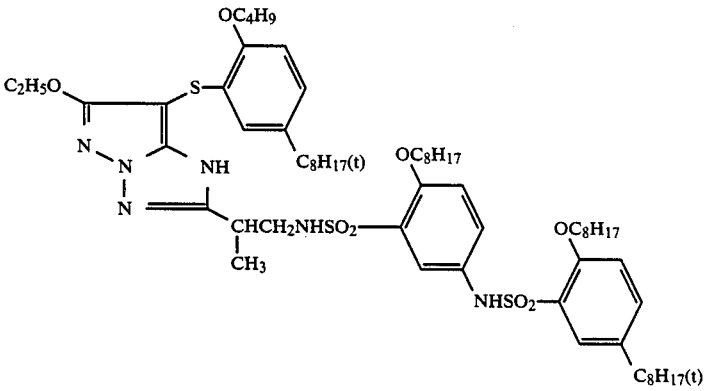

-continued (f) Color Image Stabilizer

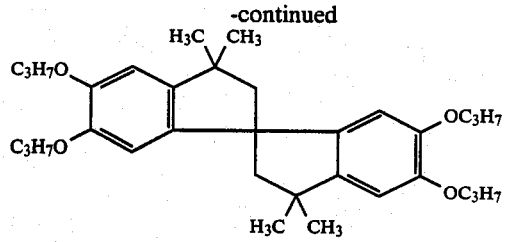

(g) Solvent

2/1 (by weight) mixture of $(C_8H_{17}O)_3P{=}O$ and

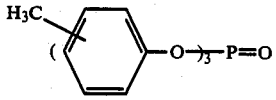

(h) Ultraviolet Absorbent

1/5/3 (by mol) mixture of

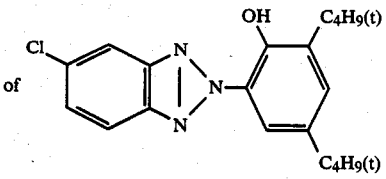

and

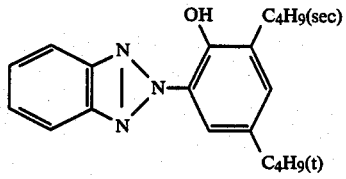

and

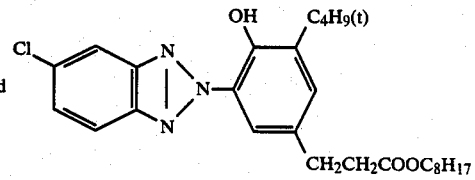

(i) Color Mixing Preventing Agent

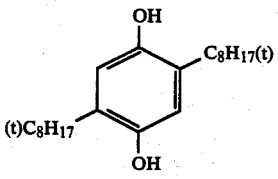

(j) Solvent $(\text{iso-}C_9H_{18}O{-})_3{-}P{=}O$ (k) Cyan Coupler

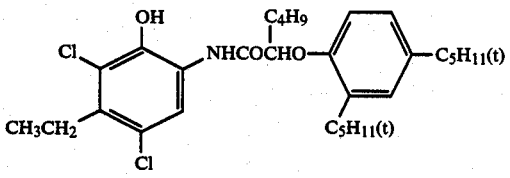

(l) Color Image Stabilizer

1/3/3 (by mol) mixture of

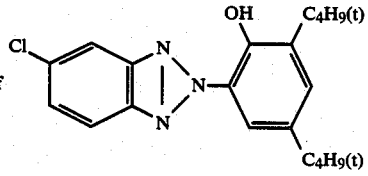

and

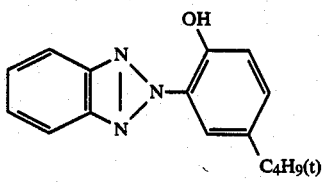

and

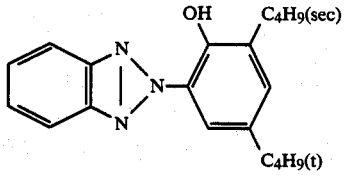

TABLE 9

| | |
|---|---|
| **Seventh Layer (Protective Layer)** | |
| Gelatin | 1.33 g/m$^2$ |
| Acryl denatured copolymer of polyvinyl alcohol (denaturing degree: 17%) | 0.17 g/m$^2$ |
| **Sixth Layer (Ultraviolet Absorbent Layer)** | |
| Gelatin | 0.54 g/m$^2$ |

TABLE 9-continued

| | |
|---|---|
| Ultraviolet Absorbent (h) | 0.21 g/m$^2$ |
| Solvent (j) | 0.09 ml/m$^2$ |
| **Fifth Layer (Red-Sensitive Layer)** | |
| Silver chlorobromide emulsion (bromide content: 3.0 mol %) | 0.24 g/m$^2$ |
| Gelatin | 0.96 g/m$^2$ |

TABLE 9-continued

| | |
|---|---|
| Cyan Coupler (k) | 0.38 g/m² |
| Color Image Stabilizer (l) | 0.17 g/m² |
| Solvent (c) | 0.23 ml/m² |
| Fourth Layer (Ultraviolet Absorbent Layer) | |
| Gelatin | 1.60 g/m² |
| Ultraviolet Absorbent (h) | 0.62 g/m² |
| Color Mixing Preventing Agent (i) | 0.05 g/m² |
| Solvent (j) | 0.26 ml/m² |
| Third Layer (Green-Sensitive Layer) | |
| Silver chlorobromide emulsion (bromide content: 1.0 mol %) $G_2$, $G_4$ or $G_8$ | 0.16 g/m² |
| Gelatin | 1.80 g/m² |
| Magenta Coupler (e) | 0.45 g/m² |
| Color Image Stabilizer (f) | 0.20 g/m² |
| Solvent (g) | 0.45 ml/m² |
| Second Layer (Color Mixing Preventing Layer) | |
| Gelatin | 0.99 g/m² |
| Color Mixing Preventing Agent (d) | 0.08 g/m² |
| First Layer (Blue-Sensitive Layer) | |
| Silver chlorobromide emulsion (bromide content: 1.0 mol %) | 0.27 g/m² |
| Gelatin | 1.86 g/m² |
| Yellow Coupler (a) | 0.74 g/m² |
| Color Image Stabilizer (b) | 0.17 g/m² |
| Solvent (c) | 0.31 ml/m² |

SUPPORT

Polyethylene laminated paper (containing $TiO_2$ and ultramarine in polyethylene laminate on first layer side)

Amounts of silver chlorobromide emulsions are based on silver coverage.

The color photographic paper thus obtained was exposed to light through an optical wedge, and subsequently subjected to the processing including the following steps.

| Processing Step | Time | Temperature (°C.) |
|---|---|---|
| Color Development | 45 sec | 35 |
| Bleach-Fixing | 45 sec | 35 |
| Rinsing (4 tank cascade) | 1 min 30 sec | 30 |
| Drying | 50 sec | 80 |

Compositions of the processing solutions used were as follows:

| | |
|---|---|
| Color Developing Solution: | |
| Water | 800 ml |
| Diethylenetriaminepentaacetic Acid | 1.0 g |
| Sodium Sulfite | 0.2 g |
| N,N—Diethylhydroxylamine | 4.2 g |
| Potassium Bromide | 0.01 g |
| Sodium Chloride | 1.5 g |
| Triethanolamine | 8.0 g |
| Potassium Carbonate | 30 g |
| N—Ethyl-N—(β-methanesulfonamidoethyl)-3-methyl-4-aminoaniline Sulfate | 4.5 g |
| Brightening Agent of 4,4'-Diaminostilbene Type (Whitex 4, trademark of Sumitomo Chemical Co., Ltd.) | 2.0 g |
| Water to make | 1,000 ml |
| KOH to adjust pH to | 10.25 |
| Bleach-Fixing Solution: | |
| Water | 400 ml |
| Ammonium Thiosulfate (70%) | 150 ml |
| Sodium Sulfite | 18 g |
| Ammonium Ethylenediaminetetraacetato Ferrate(III) | 55 g |
| Ethylenediaminetetraacetic Acid | 5 g |
| Water to make | 1,000 ml |
| Acetic Acid to adjust pH to | 5.75 |

-continued

| | |
|---|---|
| Rinsing Solution: | |
| 1-Hydroxyethylidene-1,1-disulfonic Acid (60%) | 1.5 ml |
| Nitrilotriacetic Acid | 1.0 g |
| Ethylenediaminetetraacetic Acid | 0.5 g |
| Ethylenediamine-N,N,N',N'—tetramethylene-phosphonic Acid | 1.0 g |
| Bismuth Chloride (40%) | 0.5 g |
| Magnesium Sulfate | 0.2 g |
| Zinc Sulfate | 0.3 g |
| Ammonium Alum | 0.5 g |
| 5-Chloro-2-methyl-4-isothiazoline-3-one | 30 mg |
| 2-Methyl-4-isothiazoline-3-one | 10 mg |
| 2-Octyl-4-isothiazoline-3-one | 10 mg |
| Ethylene Glycol | 1.5 g |
| Sulfanylamide | 0.1 g |
| 1,2,3-Benzotriazole | 1.0 g |
| Ammonium Sulfite (40%) | 1.0 g |
| Aqueous Ammonia (26%) | 2 6 ml |
| Polyvinylpyrrolidone | 1.0 g |
| Brightening Agent of 4,4'-Diaminostilbene Type | 1.0 g |
| Water to make | 1,000 ml |
| KOH to adjust pH to | 7.0 |

As the silver chlorobromide emulsion for the third layer, the same emulsions as used in Sample G2, Sample G4 and Sample G8 produced in Example 7 were employed, and the resulting samples were designated as Sample F1, Sample F2 and Sample F3, respectively.

The results obtained are shown in Table 10.

TABLE 10

| Sample | Sensitivity | Fog | Pressure Desensitization | Pressure Mark | Remark |
|---|---|---|---|---|---|
| F1 | 100 | 0.09 | 82 | 0.15 | Comparison |
| F2 | 204 | 0.08 | 98 | 0.09 | Invention |
| F3 | 120 | 0.10 | 78 | 0.12 | Comparison |

These samples were tested in the same way as in Example 1 and Example 4. The above data were obtained by measuring the densities of magenta color developed through exposure to green light and subsequent processings. The sensitivities were relative values, with Sample F1 being taken as 100.

By analogy with the results obtained in Example 7, Sample F2 produced in accordance with the present invention had high sensitivity, and generated less pressure desensitization and pressure marks. Therefore, it is obvious that the presence of a sensitizing dye at the time of halogen replacement was of significance and advantage.

EXAMPLE 10

Samples were produced in the same manner as in Example 9, except that Sensitizing Dye D-30 and Sensitizing Dye D-99 respectively, were used in place of Sensitizing Dye D-29. Similar effects to those attained in Example 9 were observed in these samples also.

EXAMPLE 11

Emulsions were prepared in the same manner as the emulsions used for producing Samples G2, G4, G6 and G8 in Example 7, except that 84 mg of chloroauric acid was further added after a 1 minute lapse from the addition of 3 mg of sodium thiosulfate in the chemical sensitization step. These emulsions were coated to produce Samples H1, H2, H3 and H4, respectively. In addition, emulsions were prepared in the same manner as the foregoing emulsions, except that chemical sensitization was carried out using 84 mg of chloroauric acid alone without the addition of sodium thiosulfate. These emulsions also were similarly coated to produce Samples H5, H6, H7 and H8, respectively. The emulsions used for producing Samples H1 to H8 had the same variation coefficient in regard to grain size distribution as their corresponding emulsions used in Samples G2, G4, G6 and G8, respectively, regardless of chemical ripening condition.

Samples H1 to H8 were optically exposed and developed in the same manner as in Example 1. Thus, the results shown in Table 11 were obtained. The testing method and expressions of characteristics, such as sensitivity, employed in Example 1 were applied correspondingly to these samples. Comparisons were made among the samples having received chemical ripening under the same condition, and the sensitivities were shown as relative values, with Sample H1 and Sample H5 being taken as 100 in their respective groups.

TABLE 11

| Sample | Sensitivity | Fog | Pressure Desensitization | Pressure Mark | Remark |
|---|---|---|---|---|---|
| H1 | 100 | 0.05 | 84 | 0.21 | Comparison |
| H2 | 174 | 0.05 | 100 | 0.08 | Invention |
| H3 | 65 | 0.05 | 104 | 0.32 | Comparison |
| H4 | 115 | 0.05 | 88 | 0.19 | Comparison |
| H5 | 100 | 0.04 | 88 | 0.27 | Comparison |
| H6 | 166 | 0.04 | 98 | 0.06 | Invention |
| H7 | 76 | 0.04 | 104 | 0.46 | Comparison |
| H8 | 117 | 0.04 | 82 | 0.21 | Comparison |

As can be seen from the comparison among the results of Samples H1, H2, H3 and H4, the emulsion of the present invention which had received halogen replacement in the presence of Sensitizing Dye D-29 had high sensitivity, and were resistant to pressure desensitization in the case also where gold sensitization and sulfur sensitization were carried out in combination.

Also, the comparison among Samples H5 to H8 revealed that the sample which had received the halogen replacement in the presence of Sensitizing Dye D-29 had higher sensitivity and less pressure desensitization, that is, excellent properties.

EXAMPLE 12

Samples were produced in the same manner as Samples F1, F2 and F3 produced in Example 9, respectively, except that the same emulsions as used in Samples H1, H2 and H4, or the same emulsions as used in Samples H5, H6 and H8, which had been prepared in Example 11, were employed in place of the emulsions contained in the third layers of Samples F1, F2 and F3, respectively. The thus obtained samples were designated as Samples J1, J2 and J3, and Samples J4, J5 and J6, respectively. Magenta Coupler (*2) used in the third layer of Example 4 was used in an equimolar amount in place of Magenta Coupler (e) as the magenta coupler to be contained in each third layer of Samples J1, J2 and J3, and further Discoloration Inhibitor (*3) was incorporated at a coverage of 0.035 g/m$^2$ and the silver coverage was changed to 0.34 g/m$^2$ in the third layer.

These Samples J1 to J6 were optically exposed and developed in the same manner as in Example 9, and the results shown in Table 12 were obtained. The sensitivities were shown as relative values, with Sample J1 being taken as 100 for the group of Samples J1 to J3, and with Sample J4 being taken as 100 for the group of Samples J4 to J6.

TABLE 12

| Sample | Sensitivity | Fog | Pressure Desensitization | Pressure Mark | Remark |
|---|---|---|---|---|---|
| J1 | 100 | 0.11 | 92 | 0.32 | Comparison |
| J2 | 196 | 0.11 | 100 | 0.13 | Invention |
| J3 | 115 | 0.11 | 94 | 0.27 | Comparison |
| J4 | 100 | 0.10 | 94 | 0.26 | Comparison |
| J5 | 186 | 0.10 | 100 | 0.12 | Invention |
| J6 | 110 | 0.10 | 88 | 0.25 | Comparison |

The samples of the present invention, J2 and J5, which had received the halogen replacement in the presence of Sensitizing Dye D-29, has proved to demonstrate excellent properties with respect to sensitivity, pressure desensitization and pressure marks.

EXAMPLE 13

Emulsions were prepared in the same manner as the emulsions used for producing Samples H5, H6 and H8, respectively, except that a sensitizing dye having the same structure as D-94, except that p-toluenesulfonic acid ion was substituted for iodine ion as the counter ion, was used in an amount of $0.9\times10^{-4}$ mol/mol Ag in place of Spectral Sensitizing Dye D-29. Samples were produced in the same manner as Samples J4, J5 and J6 in Example 12, except that these emulsions were substituted for the emulsions used in the fifth layers, respectively. These samples were examined for properties in the same manner as in Example 12, except that exposure to red light was carried out instead of exposure to green light.

The results obtained are shown in Table 13. In this example also, the sample of the present invention, K2, had the highest sensitivity, and was superior in pressure characteristics to other samples.

TABLE 13

| Sample | Sensitivity* | Fog | Pressure Desensitization | Pressure Mark | Remark |
|---|---|---|---|---|---|
| K1 | 100 | 0.10 | 92 | 0.19 | Comparison |
| K2 | 178 | 0.10 | 98 | 0.10 | Invention |
| K3 | 105 | 0.10 | 92 | 0.16 | Comparison |

*The sensitivities are shown as relative values, with Sample K1 being taken as 100.

EXAMPLE 14

Emulsions were prepared in the same manner as the emulsions made for producing Samples K1, K2 and K3 in Example 13, except that D-22 ($5\times10^{-4}$ mol/mol Ag) was employed in place of the sensitizing dye for the red-sensitive emulsion layer, and the emulsion was controlled so as to have a mean grain size of 0.8 micron and subjected to the optimal gold sensitization. The thus prepared emulsions were employed as the emulsions for the first layer of Samples K1, K2 and K3. respectively. The resulting samples were exposed to blue light, and their properties were compared analogous to Example 12. It was found that in Example 14 also, only the sample using the emulsion of the present invention had high sensitivity and excellent pressure characteristics.

Therefore, in accordance with the embodiments of the present invention, a photographic material having high sensitivity and which is hardly subject to pressure desensitization and pressure marks can be obtained.

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising a support having thereon at least one emulsion layer which contains a silver chlorobromide or silver bromide each having an iodide content of 3 mol% or less, which is prepared in a process comprising the steps of, in sequence, forming silver halide grains which have a grain size distribution represented by a variation coefficient of 0.2 or less, causing halogen replacement in silver halide grains by addition of a water-soluble bromide in a proportion of from 0.6 to 20 mol% with respect to the total silver halide in the presence of at least one sensitizing dye selected from among simple cyanine dyes, carbocyanine dyes, and dicarboncyanine dyes at individual surfaces of the silver halide grains, and then subjecting the resulting silver halide grains to chemical sensitization.

2. A silver halide photographic material as in claim 1, wherein the water-soluble bromide is added in a proportion of from 1 to 15 mol% with respect to the total silver halide.

3. A silver halide photographic material as in claim 1, wherein said sensitizing dye is a cyanine dye represented by formula (I)

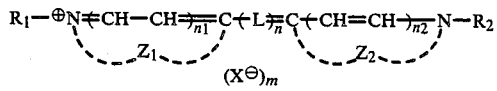

(I)

wherein L represents a methine group or a substituted methine group; $R_1$ and $R_2$ each represents an alkyl group or a substituted alkyl group; $Z_1$ and $Z_2$ each represents atoms forming a nitrogen-containing 5- or 6-membered heterocyclic nucleus; X represents an anion; n represents 1, 3, or 5; $n_1$ and $n_2$ each represents 0 to 1, provided that $n_1$ and $n_2$ are 0 when n=5, and that when n=3, either $n_1$ or $n_2$ is 0; m represents 0 or 1, provided that m is 0 when (I) forms an internal salt; or, when n represents 5, the two L groups combine together to form a substituted or unsubstituted 5- or 6-membered ring.

4. A silver halide photographic material as in claim 2, wherein said sensitizing dye is a cyanine dye represented by formula (I)

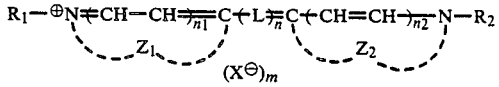

(I)

wherein L represents a methine group or a substituted methine group; $R_1$ and $R_2$ each represents an alkyl group or a substituted alkyl group; $Z_1$ and $Z_2$ each represents atoms forming a nitrogen-containing 5- or 6-membered heterocyclic nucleus; X represents an anion; n represents 1, 3 or 5; $n_1$ and $n_2$ each represents 0 to 1, provided that $n_1$ and $n_2$ are 0 when n=5, and that when n=3, either $n_1$ or $n_2$ is 0; m represents 0 or 1, provided that m is 0 when (I) forms an internal salt; or, when n represents 5, the two L groups combine together to form a substituted or unsubstituted 5- or 6-membered ring.

5. A silver halide photographic material as in claim 1, wherein said water-soluble bromide is potassium bromide, sodium bromide or ammonium bromide.

6. A silver halide photographic material as in claim 1, wherein said sensitizing dye contains a benzoxazole nucleus or a benzothiazole nucleus.

7. A silver halide photographic material as in claim 1, wherein a ratio of said sensitizing dye to the total silver halides ranges from $1\times10^{-5}$ to $4\times10^{-3}$ by mol.

8. A silver halide photographic material as in claim 1, wherein a ratio of said sensitizing dye to the total silver halides ranges from $3\times10^{-5}$ to $2\times10^{-3}$ by mol.

9. A silver halide photographic material as in claim 1, wherein the silver halide grains prior to halogen conversion have a chloride content of 4 to 100 mol% and an iodide content of 3 mol% or less.

* * * * *